US010610436B1

(12) United States Patent
Ibsies

(10) Patent No.: US 10,610,436 B1
(45) Date of Patent: Apr. 7, 2020

(54) TECHNOLOGY ASSOCIATED FURNITURE SYSTEM

(71) Applicant: Fadi Ibsies, Tigard, OR (US)

(72) Inventor: Fadi Ibsies, Tigard, OR (US)

(73) Assignee: Fadi Ibsies, Tigard, OR (US)

( * ) Notice: Subject to any disclaimer, the term of this patent is extended or adjusted under 35 U.S.C. 154(b) by 282 days.

(21) Appl. No.: 15/406,792

(22) Filed: Jan. 16, 2017

(51) Int. Cl.

| | |
|---|---|
| ***A61G 15/10*** | (2006.01) |
| ***A47C 1/02*** | (2006.01) |
| ***A61G 15/02*** | (2006.01) |
| ***A47C 7/72*** | (2006.01) |
| ***A47C 31/00*** | (2006.01) |
| ***A47C 21/00*** | (2006.01) |

(52) U.S. Cl.
CPC ..... *A61G 15/10* (2013.01); *A47C 1/02* (2013.01); *A47C 7/72* (2013.01); *A47C 21/003* (2013.01); *A47C 31/007* (2013.01); *A61G 15/02* (2013.01)

(58) Field of Classification Search
CPC ..... A47C 7/72; A47C 1/02; A47C 21/003; A47C 31/007; A61G 15/10; A61G 15/02; A61L 2202/15; A61L 2/22
USPC ..... 297/188.09, 188.1
See application file for complete search history.

(56) References Cited

U.S. PATENT DOCUMENTS

| | | | | |
|---|---|---|---|---|
| 2,592,687 | A * | 4/1952 | Halmrast | A61L 2/00 422/304 |
| 3,172,699 | A | 3/1965 | Naughton et al. | |
| 3,954,407 | A | 5/1976 | Andary et al. | |
| 4,415,203 | A | 11/1983 | Cawley | |
| 4,810,996 | A * | 3/1989 | Glen | G08B 3/10 340/321 |
| 4,934,933 | A | 6/1990 | Fuchs | |
| 5,127,521 | A | 7/1992 | Bourque | |
| 5,311,210 | A | 5/1994 | O'Brien et al. | |
| 5,348,472 | A | 9/1994 | Joeckel et al. | |
| 5,487,877 | A | 1/1996 | Choi | |
| 5,628,546 | A | 5/1997 | Boetzkes | |

(Continued)

FOREIGN PATENT DOCUMENTS

| | | | |
|---|---|---|---|
| CN | 202950992 U | * | 5/2013 |
| CN | 202951651 U | * | 5/2013 |
| CN | 103566386 A | * | 2/2014 |

OTHER PUBLICATIONS

National Maternal and Child Oral Health Resource Center, "Chapter 2: Facilities and Staffing, Safety Net Dental Clinic Manual", copyright 2011, www.DentalClinicManual.com, U.S.A., 5 pages.

(Continued)

*Primary Examiner* — Milton Nelson, Jr.
(74) *Attorney, Agent, or Firm* — Law Office of Karen Dana Oster, LLC

(57) ABSTRACT

A system in which technology is associated with adjustable furniture includes at least one use position (in which the technology is available for use) and a storage position (in which the technology is not available for use). The technology is movable between the use position and the storage position. At least one use position is preferably located near the head of the furniture. In the storage position, the technology may be in a container, which may be a sterilizing container. The movement of the technology between the use position and the storage position may be coordinated with the transition between the upright position of the furniture and the recline position of the furniture.

22 Claims, 16 Drawing Sheets

(56) References Cited

U.S. PATENT DOCUMENTS

| | | | | |
|---|---|---|---|---|
| 5,645,313 | A | 7/1997 | Best et al. | |
| 5,752,827 | A * | 5/1998 | Baron | A61C 19/043 433/29 |
| 6,278,122 | B1 * | 8/2001 | Gagnon | A61L 2/10 250/455.11 |
| 6,382,725 | B1 | 5/2002 | Carroll | |
| 6,458,331 | B1 | 10/2002 | Roberts | |
| 7,195,219 | B2 | 3/2007 | Irwin et al. | |
| 7,927,099 | B2 * | 4/2011 | Edwards | A61C 1/081 433/80 |
| 8,201,781 | B2 | 6/2012 | Parsons | |
| 8,597,569 | B2 | 12/2013 | Gruen et al. | |
| 8,753,571 | B2 | 6/2014 | Hsu et al. | |
| 9,105,174 | B2 * | 8/2015 | Harris | G08B 21/18 |
| 2003/0034459 | A1 * | 2/2003 | Bonin | A61L 2/06 250/491.1 |
| 2004/0007907 | A1 | 1/2004 | DiRe | |
| 2004/0114034 | A1 | 6/2004 | Squilla et al. | |
| 2006/0071513 | A1 * | 4/2006 | Pedemonte | A47C 1/143 297/16.1 |
| 2006/0104071 | A1 | 5/2006 | Parsons | |
| 2007/0078878 | A1 * | 4/2007 | Knable | G09B 5/06 |
| 2011/0043451 | A1 * | 2/2011 | Ibsies | A61C 19/00 345/168 |
| 2011/0195374 | A1 * | 8/2011 | Boren | A61G 15/002 433/33 |

OTHER PUBLICATIONS

Alibaba.com, "AJ-B660 Computer-controlled Dental Chair Unit", at least as early as Sep. 14, 2015, www.aj-medical.en.alibaba.com/product/1417710011-213400645/AJ-B660_Computer_controlled_Dental_Chair_Unit, U.S.A, 2 pages.

Alibaba.com, "Computer controlled Multi-functional dental chair TJ-2688D4 luxury dental chair unit Integral Dental Unit", at least as early as Sep. 14, 2015, www.alibaba.com/product-detail/computer-controlled-Multi-functional-dental-chair_1817112106.html, U.S.A, 2 pages.

* cited by examiner

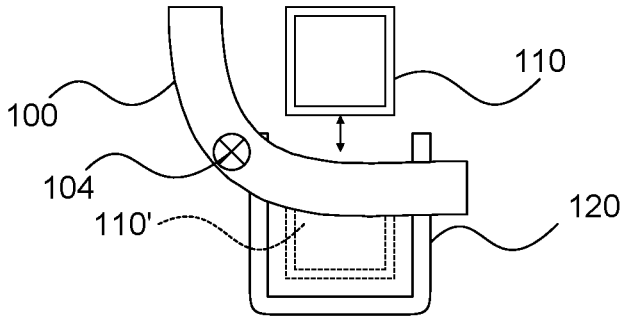
FIG. 16
FIG. 17
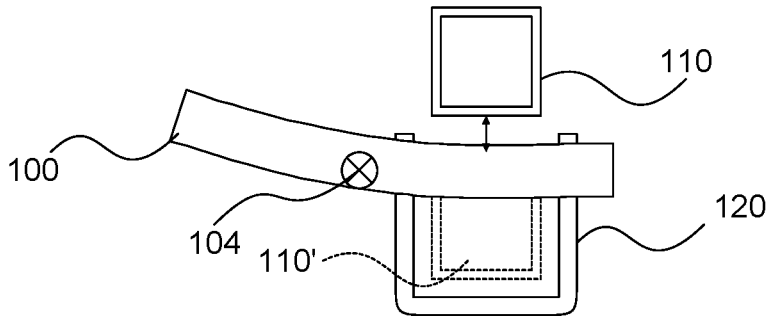
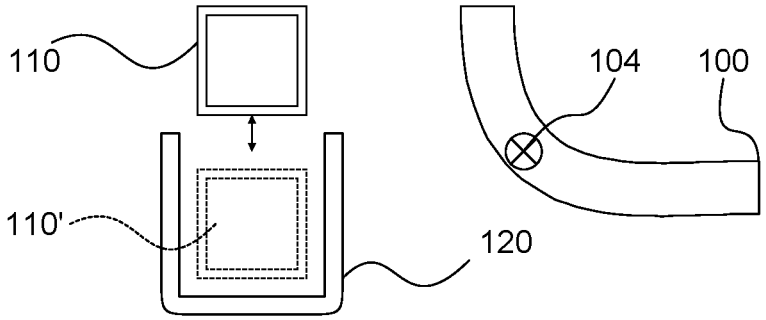
FIG. 18
FIG. 19
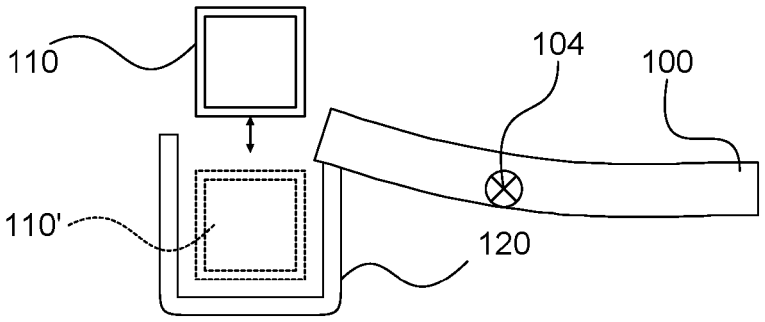

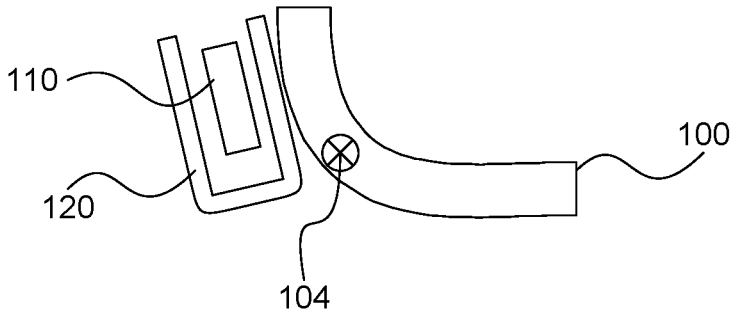
FIG. 22
FIG. 23
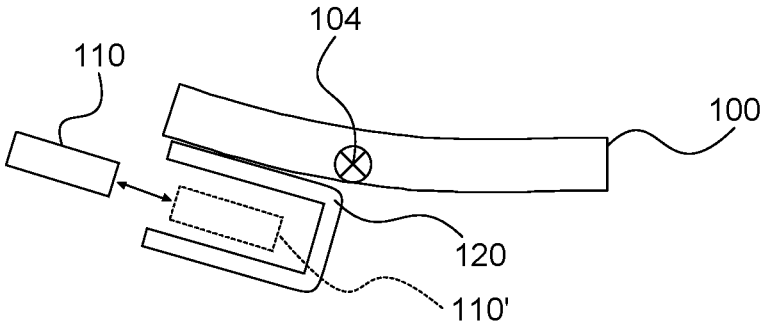
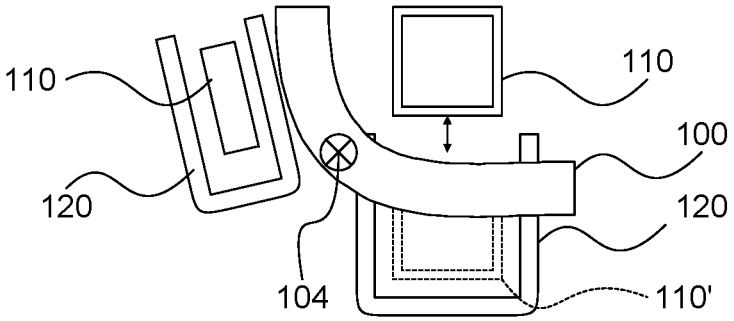
FIG. 24
FIG. 25
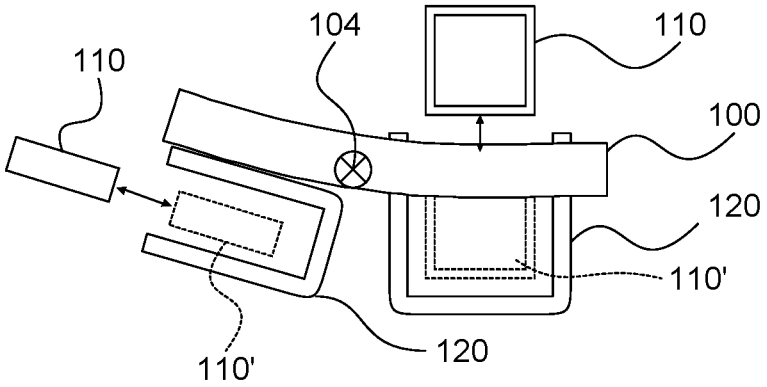

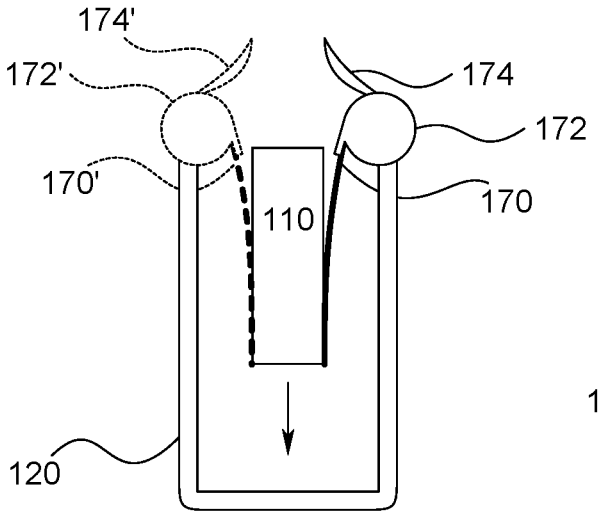
FIG. 32
FIG. 33
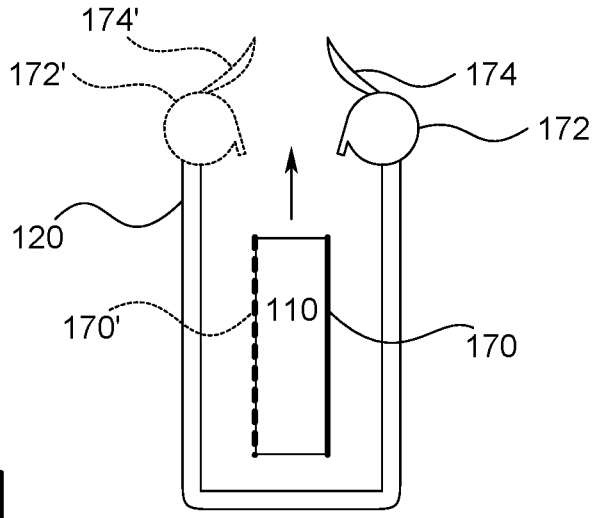
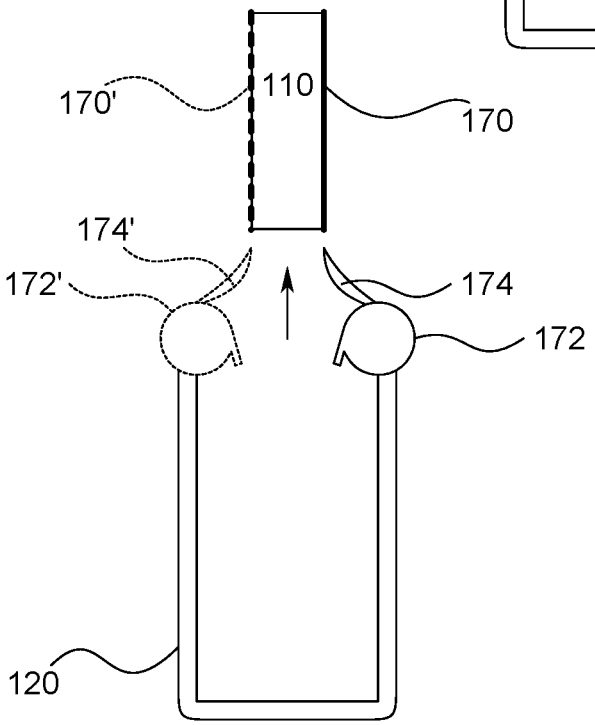
FIG. 34

TECHNOLOGY ASSOCIATED FURNITURE SYSTEM

BACKGROUND OF THE INVENTION

A technology associated furniture system and, in particular, a computer screen and/or keyboard technology associated adjustable furniture system.

Dental professionals are increasingly relying on technology for purposes including, but not limited to, record keeping, and patient education. However, in a traditional dental office (a small room with a dental chair in the middle of it) it is difficult to find the right place for the technology. Similar issues are present in other types of medical facilities and even in other professional and non-professional settings.

Adjustable furniture, including dental chairs are well known. The following references describe some of the relevant art: U.S. Pat. No. 3,172,699 to Naughton, U.S. Pat. No. 4,415,203 to Cawley, U.S. Pat. No. 5,645,313 to Best et al., U.S. Pat. No. 5,628,546 to Boetzkes, U.S. Pat. No. 6,382,725 to Carroll, and U.S. Pat. No. 7,195,219 to Irwin et al.

Adjustable technology, including screens/keyboards are well known. The following references describe some of the relevant art: U.S. Pat. No. 5,311,210 to O'Brien et al., U.S. Patent Application Publication No. 2004/0007907 to DiRe, U.S. Patent Application Publication No. 2004/0114034 to Squilla et al., U.S. Patent Application Publication No. 2006/0104071 to Parsons, Sterilizing is well known. The following references describe some of the relevant art: U.S. Pat. No. 6,278,122 to Gagnon, U.S. Pat. No. 5,487,877 to Choi, U.S. Pat. No. 6,458,331 to Roberts, U.S. Pat. No. 8,597,569 to Gruen et al., U.S. Pat. No. 8,753,571 to Hsu et al., The above cited references are relevant from the perspective of providing general overviews of relevant technology.

BRIEF SUMMARY OF THE INVENTION

A technology associated furniture system and, in particular, a computer screen and/or keyboard technology associated adjustable furniture system.

Described herein is a technology associated furniture system for associating technology with adjustable furniture. The system includes at least one use position in which the technology is available for use, a storage position in which the technology is not available for use and the technology being movable between the use position and the storage position. The at least one use position may be a patient use position in which the technology is available for patient use. The at least one use position may be a practitioner use position in which the technology is available for practitioner use. The practitioner use position may be located near the head of the furniture. In the storage position, the technology may be behind, under, or along the side of the furniture. In the storage position, the technology may be in a container, which may be a sterilizing container. The system may have at least two use positions, one use position being a first practitioner use position and one use position being a second practitioner use position. Alternatively, if there are at least two use positions, one use position may be a practitioner use position and one use position may be a patient use position. Another alternative having two use positions could include two patient use positions. The movement of the technology between the use position and the storage position may be coordinated with the transition between the upright position of the furniture and the recline position of the furniture.

Also described herein is a technology associated furniture system for associating a first technology and a second technology with adjustable furniture. The first technology preferably has at least one patient use position and a storage position. In the at least one patient use position, the first technology is available for patient use. The first technology is preferably movable between the at least one patient use position and the storage position. The second technology preferably has at least one practitioner use position and a storage position. In the at least one practitioner use position, the second technology is available for practitioner use. The second technology is preferably movable between the at least one practitioner use position and the storage position. The at least one practitioner use position is preferably located near the head of the furniture. The storage position for the first technology may be behind, under, or along the side of the furniture, and the storage position for the second technology may be behind, under, or along the side of the furniture. The storage positions may be in a container. The container may be a sterilizing container. Movement of the first technology between the use position and the storage position may be coordinated with the transition between the upright position of the furniture and the recline position of the furniture. Movement of the second technology between the use position and the storage position may be coordinated with the transition between the upright position of the furniture and the recline position of the furniture.

Also described herein is a technology associated furniture system for associating a first technology and a second technology with adjustable furniture. The first technology preferably has at least one patient use position and a storage position. In the at least one patient use position, the first technology is available for patient use. The first technology is preferably movable between the at least one patient use position and the storage position. The storage position for the first technology may be in a container. The second technology preferably has at least one practitioner use position and a storage position. In the at least one practitioner use position, the second technology is available for practitioner use. The second technology is preferably movable between the at least one practitioner use position and the storage position. The storage position for the second technology may be in a container. The storage position for the first technology may be behind, under, or along the side of the furniture, and the storage position for the second technology may be behind, under, or along the side of the furniture. The storage position for the first technology may be in a sterilizing container, and the storage position for the second technology may be in a sterilizing container.

The subject matter described herein is particularly pointed out and distinctly claimed in the concluding portion of this specification. Objectives, features, combinations, and advantages described and implied herein will be more readily understood upon consideration of the following detailed description of the invention, taken in conjunction with the accompanying drawings.

BRIEF DESCRIPTION OF THE SEVERAL VIEWS OF THE DRAWINGS

The accompanying drawings illustrate various exemplary technology associated furniture systems and/or provide teachings by which the various exemplary technology associated furniture systems are more readily understood.

FIGS. 16-17 are side views of a dental chair and a single technology adjacent the dental chair, the single technology movable between a storage position and a use position (FIG. 16) when the dental chair is upright, and between a storage position and a use position (FIG. 17) when the dental chair is reclined.

FIGS. 18-19 are side views of a dental chair and a single technology behind the dental chair, the single technology movable between a storage position and a use position (FIG. 18) when the dental chair is upright, and between a storage position and a use position (FIG. 19) when the dental chair is reclined.

FIGS. 22-23 are side views of a dental chair and a single alternatively situated technology behind the dental chair, the single alternatively situated technology is preferably in a storage position (FIG. 22) when the dental chair is upright, and movable between a storage position and a use position (FIG. 23) when the dental chair is reclined.

FIGS. 24-25 are side views of a dental chair and two technologies, a first alternatively situated technology behind the dental chair and a second technology adjacent the dental chair, the first technology independently movable between a storage position and a use position (FIG. 24) when the dental chair is upright, and both technologies independently movable between a storage position and a use position (FIG. 25) when the dental chair is reclined.

FIGS. 32-36 are end views of a third exemplary sterilization system in which at least one face of a technology is sterilized using a sterilized coating or sheet as the technology moved from a use position to a storage position.

Figure 1:
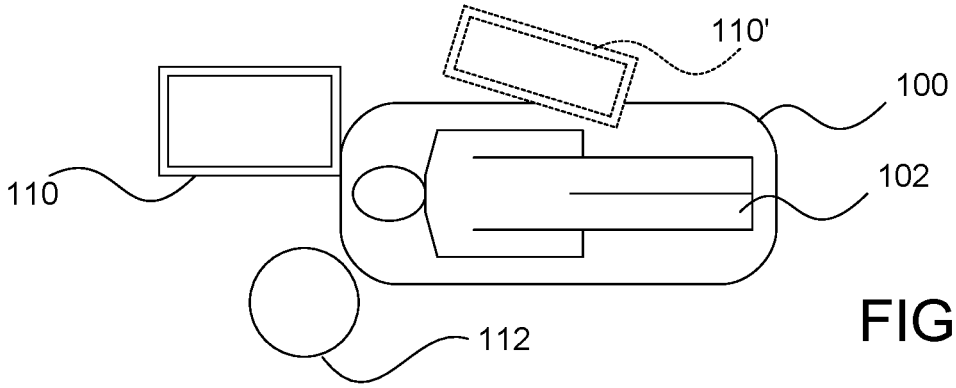
FIG. 1 is a top plan view of a dental chair and technology aligned for a primary dental practitioner's use.

The drawing figures are not necessarily to scale. Certain features or components herein may be shown in somewhat schematic form and some details of conventional elements may not be shown or described in the interest of clarity and conciseness. The drawing figures are hereby incorporated in and constitute a part of this specification.

DETAILED DESCRIPTION OF THE INVENTION

A technology associated furniture system is described herein. In particular, a computer screen and/or keyboard technology associated adjustable furniture system is described herein. Some preferred systems incorporate sterilization.

As set forth in the background, dental professionals are increasingly relying on technology for purposes including, but not limited to, record keeping, and patient education. However, in a traditional dental office (a small room with a dental chair in the middle of it) it is difficult to find the right place for the technology. Similar issues are present in other types of medical facilities and even in other professional and non-professional settings. The system described herein recognizes these issues and seeks to rectify them by providing a technology associated furniture system that is convenient both in its positioning during use and during storage. The positioning may be automated for convenience. The system described herein also provides additional features that provide automatic sterilization of technology which is crucial in dental and medical offices. The sterilization may be automated for convenience.

A first preferred system described herein is a technology associated furniture system for associating technology 110 with a dental chair 100. The system includes at least one use position in which the technology 110 is available for use, a storage position in which the technology 110 is not available for use and the technology 110 being movable between the use position and the storage position. The at least one use position may be a patient use position in which the technology 110 is available for patient use. The at least one use position may be a practitioner use position in which the technology 110 is available for practitioner use. The practitioner use position may be located near the head of the dental chair 100. In the storage position, the technology 110 may be behind, under, or along the side of the dental chair 100. In the storage position, the technology 110 may be in a container 120, which may be a sterilizing container 120. The system may have at least two use positions, one use position being a first practitioner use position and one use position being a second practitioner use position. Alternatively, if there are at least two use positions, one use position may be a practitioner use position and one use position may be a patient use position. Another alternative having two use positions could include two patient use positions. The movement of the technology 110 between the use position and the storage position may be coordinated with the transition between the upright position of the dental chair 100 and the recline position of the dental chair 100.

A second preferred system described herein is a technology associated furniture system for associating a first technology 110 and a second technology 110 with a dental chair 100. The first technology 110 preferably has at least one patient use position and a storage position. In the at least one patient use position, the first technology 110 is available for patient use. The first technology 110 is preferably movable between the at least one patient use position and the storage position. The second technology 110 preferably has at least one practitioner use position and a storage position. In the at least one practitioner use position, the second technology 110 is available for practitioner use. The second technology 110 is preferably movable between the at least one practitioner use position and the storage position. The at least one practitioner use position is preferably located near the head of the dental chair 100. The storage position for the first technology 110 may be behind, under, or along the side of the dental chair 100, and the storage position for the second technology 110 may be behind, under, or along the side of the dental chair 100. The storage positions may be in a container 120. The container 120 may be a sterilizing container 120. Movement of the first technology 110 between the use position and the storage position may be coordinated with the transition between the upright position of the dental chair 100 and the recline position of the dental chair 100. Movement of the second technology 110 between the use position and the storage position may be coordinated with the transition between the upright position of the dental chair 100 and the recline position of the dental chair 100.

A third preferred system described herein is a technology associated furniture system for associating a first technology 110 and a second technology 110 with a dental chair 100. The first technology 110 preferably has at least one patient use position and a storage position. In the at least one patient use position, the first technology 110 is available for patient use. The first technology 110 is preferably movable between the at least one patient use position and the storage position. The storage position for the first technology 110 may be in a container 120. The second technology 110 preferably has at least one practitioner use position and a storage position. In the at least one practitioner use position, the second technology 110 is available for practitioner use. The second technology 110 is preferably movable between the at least one practitioner use position and the storage position. The storage position for the second technology 110 may be in a container 120. The storage position for the first technology 110 may be behind, under, or along the side of the dental chair 100, and the storage position for the second technology 110 may be behind, under, or along the side of the dental chair 100. The storage position for the first technology 110 may be in a sterilizing container 120, and the storage position for the second technology 110 may be in a sterilizing container 120.

Exemplary technology associated furniture systems may be better understood with reference to the drawings, but these exemplary technology associated furniture systems are not intended to be of a limiting nature. The same reference numbers will be used throughout the drawings and description in this document to refer to the same or like parts. The shown shapes and relative dimensions are preferred, but are not meant to be limiting unless specifically claimed, in which case they may limit the scope of that particular claim.

DEFINITIONS

Before describing the technology associated furniture system and the figures, some of the terminology should be clarified. Please note that the terms and phrases may have additional definitions and/or examples throughout the specification. Where otherwise not specifically defined, words, phrases, and acronyms are given their ordinary meaning in the art. The following paragraphs provide some of the definitions for terms and phrases used herein.

The term "technology" is used herein generically to mean a computer screen and/or keyboard technology. Although the technology may be a computer screen alone or a keyboard alone, it may also be a touch screen device such as a tablet or an IPAD®. In particular, the technology may be the technology described in U.S. Patent Application Publication No. 2011/0043451, U.S. Patent Application Publication No. 2012/0194546, U.S. Patent Application Publication No. 2014/0002364, U.S. Design Pat. No. D775,655, all owned by the applicant of the present application, which are incorporated herein by reference.

The term "furniture" is used herein to generically describe an item upon which a person may lie or sit. A preferred type of furniture is adjustable furniture that can be configured in multiple configurations (e.g. both upright and reclined). Throughout this document, the exemplary furniture described is a dental chair 100 that can be configured both upright (upright position) and reclining (recline position). Similar furniture may be used for other medical or professional purposes. For the purpose of description, the furniture will be described as having an upper resting surface, a head end at a first end of the upper surface, a foot end at a second end of the upper surface, and two sides that span the distance between the head end and the foot end. Although described as a dental chair herein, unless a claim limits the furniture to the dental chair, other types of furniture or adjustable furniture are included in the invention. Exemplary dental chairs include, but are not limited to, those described in U.S. Pat. No. 3,172,699 to Naughton, U.S. Pat. No. 4,415,203 to Cawley, U.S. Pat. No. 5,645,313 to Best et al., U.S. Pat. No. 5,628,546 to Boetzkes, and U.S. Pat. No. 6,382,725 to Carroll, which are incorporated herein by reference.

The terms "movement," "moving," "move," and variations thereof are used to generically describe three distinct types of movement: traveling/locating, positioning, and orientating. The terms "traveling" (and variations thereof) and "locating" (and variations thereof) describe the movement between locations. For example, in FIGS. 4-7 and FIGS. 8-11 the technology 110 travels between the patient's location and the practitioner's location. The term "positioning" (and variations thereof) describes the movement between a plurality of positions. For example, the technology 110 is positioned between a "storage position" and a "use position." The term "orientating" (and variations thereof) describes the movement between a plurality of orientations. For example, as shown in FIGS. 45-47 and FIGS. 48-50, the technology 110 may oriented in almost any orientation so that a user (e.g. a patient or a practitioner) can easily and conveniently see and/or touch the technology 110. These movements may be used alone or in combination. Multiple types of movement may be performed concurrently or in a sequence. Some or all of the movement may be performed manually, automatically, and/or a hybrid/combination of manually and automatically.

The phrases "storage position" and "use position" refer to the placement of the technology 110. When the technology 110 is in the use position, it is available for use (e.g. by a practitioner or by a patient). When the technology 110 is in the storage position, it is not available for use (e.g. it is out of the way, in a safe place, and/or being sterilized). The technology 110 may be situated within a container 120 when it is in the storage position and the technology 110 emerges from the container 120 so that it may be accessible and usable in at least one use position. The storage and use positions may also be based on the accessibility of the technology 110. For example, an out of the way situation (e.g. behind, under, or along the side of the furniture) may be a storage position even if there is no container. The precise storage and/or use positions may be adjusted for a particular user (the patient 102 or the practitioner 112, 112").

The phrase "dental practitioner" is used to describe, for example, a dentist, an orthodontist, dental assistant, and a dental hygienist. If the furniture used is not a dental chair, but some other type of furniture, then the practitioner would be one appropriate for the use of the furniture. For example, if the furniture is a medical table, then the practitioner would be a medical practitioner. The term "practitioner" is used to generically describe all practitioners, but "dental practitioner" is used herein as an example of a practitioner.

The term "associated" is defined to mean integral or original, retrofitted, attached, connected (including functionally connected), situated near, and/or accessible by. For example, if technology is associated with furniture, the technology may be built into the furniture, retrofitted into the furniture, attached to the furniture, situated near the furniture, and/or a accessible by the furniture.

It should be noted that relative terms (e.g. primary and secondary) are meant to help in the understanding of the technology and are not meant to limit the scope of the invention. Similarly, unless specifically stated otherwise, the terms "first," "second," and "third" are meant solely for purposes of designation and not for order or limitation.

It should be noted that some terms used in this specification are meant to be relative. For example, the term "head" (used herein in relation to the furniture) is meant to be relative to the term "foot" (used herein in relation to the furniture). The term "front" is meant to be relative to the term "back," and the term "side" is meant to describe a "face," "edge," or "surface" that connects the "front" and the "back." Rotation of the system or component that would change the designation might change the terminology, but not the concept.

The terms "may," "might," "can," and "could" are used to indicate alternatives and optional features and only should be construed as a limitation if specifically included in the claims. It should be noted that the various variations, components, elements, features, steps, or embodiments thereof are all "preferred" whether or not it is specifically indicated. Claims not including a specific limitation should not be construed to include that limitation.

Unless specifically stated otherwise, the term "exemplary" is meant to indicate an example, representation, and/or illustration of a type. The term "exemplary" does not necessarily mean the best or most desired of the type. It should be noted that, unless otherwise specified, the term "or" is used in its nonexclusive form (e.g. "A or B" includes A, B, A and B, or any combination thereof, but it would not have to include all of these possibilities). It should be noted that, unless otherwise specified, "and/or" is used similarly (e.g. "A and/or B" includes A, B, A and B, or any combination thereof, but it would not have to include all of these possibilities). It should be noted that, unless otherwise specified, the terms "includes," "has," and "contains" (and variations of these terms) mean "comprises" (e.g. a device that "includes," "has," or "contains" A and B, comprises A and B, but optionally may contain C or additional components other than A and B).

It should be noted that, unless otherwise specified, the singular forms "a," "an," and "the" refer to one or more than one, unless the context clearly dictates otherwise. Similarly, unless specifically limited, the use of singular language (e.g. "component," "module," or "step") may include plurals (e.g. "components," "modules," or "steps"), unless the context clearly dictates otherwise.

Basic Technology Associated Furniture System

Figure 2:
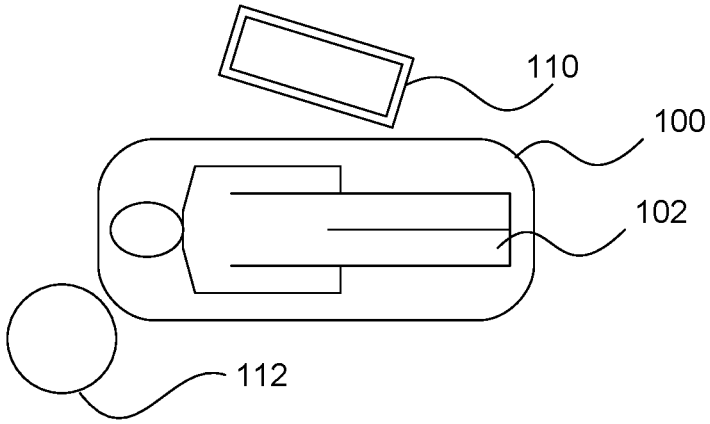
FIG. 2 is a top plan view of a dental chair and technology aligned for a patient's use.
Figure 3:
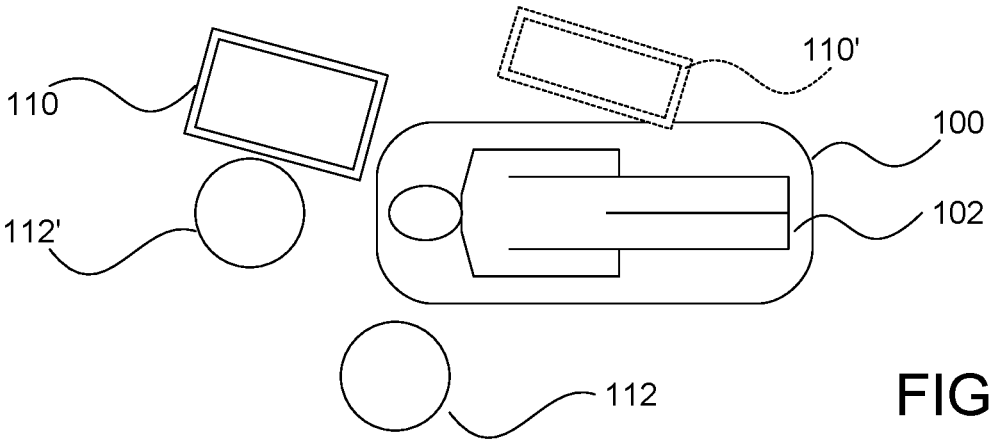
FIG. 3 is a top plan view of a dental chair and technology aligned for a secondary dental practitioner's use.
Figure 4:
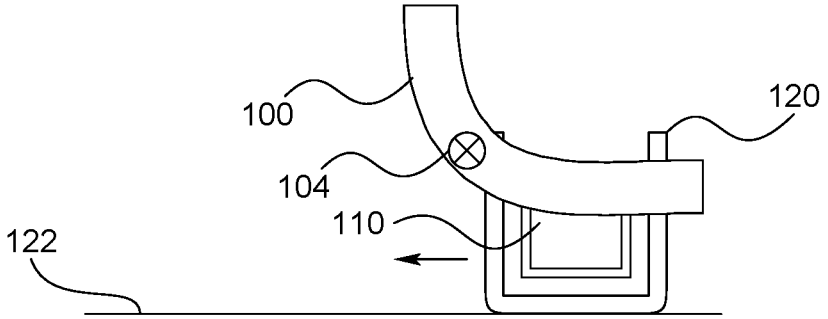
FIGS. 4-7 are side views of a dental chair and a single technology, the single technology moving from a storage position (FIG. 4) to a use position (FIG. 7) behind the dental chair as the dental chair reclines.
Figure 5:
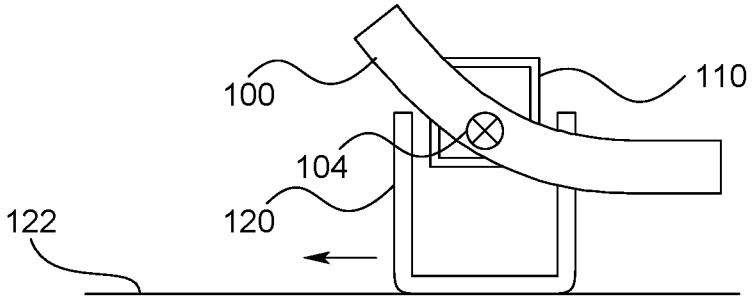
Figure 6:
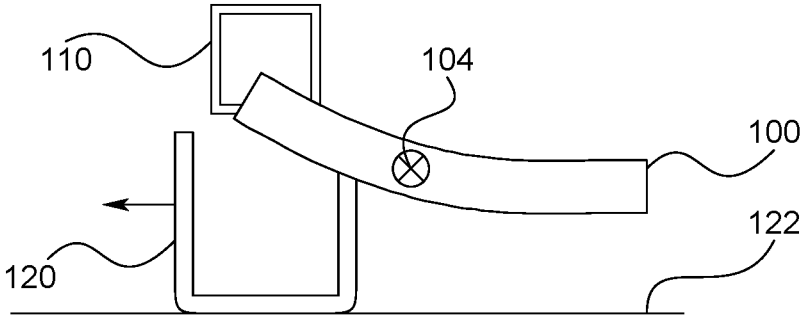
Figure 7:
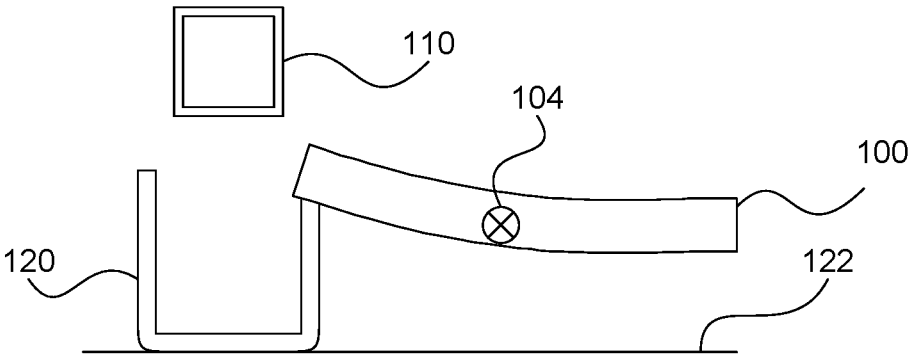

FIGS. 1-3 show three exemplary uses of the technology associated furniture system. FIG. 1 and FIG. 3 show technology 110 located or locatable near the patient's head, which is a unique feature of some of the preferred systems described herein. FIG. 2 shows an alternative system in which the technology 110 is not located near the patient's head.

In FIG. 1, a patient 102 is settled in a dental chair 100 and a dental practitioner 112 (e.g. a dentist or a hygienist) is stationed near the patient's head. The technology 110 is configured primarily for the primary dental practitioner's use. The technology 110' shown in phantom may be an initial location/position of the technology 110 (e.g. as shown in FIGS. 4-7 or FIGS. 8-11) or the technology may optionally (may not be used as shown in FIGS. 18-19 and FIGS. 22-23, or may be used as shown in FIGS. 20-21 and FIGS. 24-25).

In FIG. 2, a patient 102 is settled in a dental chair 100 and the dental practitioner 112 is stationed near the patient's head. The technology 110 in this figure is configured primarily for the patient's use. This is shown, for example, in FIGS. 12-15 and FIGS. 16-17. Having technology 110 available for the patient's use would allow the user to complete forms on the technology, receive education (e.g. video education) on the technology, follow in real time images or charting (e.g. transferred from a dental practitioner's computer) on the technology, or receive entertainment (e.g. video or games) on the technology.

In FIG. 3, a patient 102 is settled in a dental chair 100, a primary dental practitioner 112 is stationed near the patient's head, and a secondary dental practitioner 112' (e.g. a clerk or other person doing data entry) is also stationed near the patient's head. This configuration is similar to the technology 110 of FIG. 1 and, except where otherwise noted, will be discussed in conjunction therewith. It should be noted, however, that the location, position, and/or orientation of the technology 110 may be different between the FIG. 1 configuration and the FIG. 3 configuration. For example, the system of FIG. 1 may be used as the system of FIG. 3 just by reorienting the technology 110. (There may also be differences in the location and/or position of the technology 110 between the FIG. 1 configuration and the FIG. 3 configuration.)

Variations of the Technology Associated Furniture System

Variations on the technology associated furniture system include, but are not limited to variations of the location(s) of the technology, the position(s) of the technology, and the orientation(s) of the technology. Other variations include, but are not limited to, variations on whether there is a container and, if there is a container, whether there is sterilization associated with the container. As an example, as discussed in conjunction with FIGS. 22-29, FIG. 30, FIG. 31, and FIGS. 32-36, the technology 110 may be positioned within a container 120 when it is in a "storage position" and the technology 110 emerges from the container 120 so that it may be accessible and usable in at least one "use position." If there is no container (as shown in FIGS. 37-40 and FIGS. 41-44), then the "storage position" could be, for example, an out of the way position (e.g. behind, under, or along the side of the furniture). As will be discussed, the precise use location, position, and/or orientation of the technology(s) may be adjusted for a particular user (the patient 102 or the practitioner 112, 112"). Another variation is whether the movement of the technology 110 is coordinated with the transition between the upright position of the dental chair 100 and the recline position of the dental chair 100.

Turning to the exemplary system shown in FIGS. 4-7, this system is shown as including a dental chair 100 and a single technology 110. The single technology 110 moves from a storage position (FIG. 4) to a use position (FIG. 7) behind the dental chair 100 as the dental chair 100 reclines. In addition, the single technology 110 moves from a use position (FIG. 7) to a storage position (FIG. 4) as the dental chair 100 returns to an upright position. Put another way, the position of the technology 110 is inverse to the position of the dental chair 100 in that when the technology is "up" the chair is "down," and when the technology is "down" the chair is "up." In this example, there are three movements (which may be individually or jointly implemented automatically and/or manually): traveling, positioning, and orientating (FIGS. 45-47 and FIGS. 48-50). In this exemplary system, a dental practitioner 112 would preferably activate the system using an actuator 104. After activation, the technology 110 travels from a first location (shown as adjacent to the dental chair 100) to a second location behind the dental chair 100. The technology 110 also transitions from within the container 120 (a storage position) to outside of the container 120 (a use position). The container 120 may be a different type of container, may be a sterilizing container, or may be omitted. The technology 110 may also be oriented to almost any desired orientation as shown in FIGS. 45-47 and FIGS. 48-50. Using the actuator, the technology 110 may be returned to its original configuration or another configuration.

Figure 8:
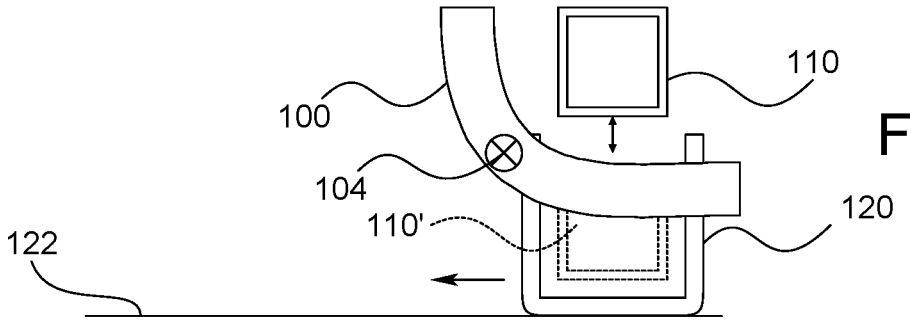
FIGS. 8-11 are side views of a dental chair and a single technology, the single technology moving from a storage position (FIG. 8) to a primary use position (FIG. 11) behind the dental chair as the dental chair reclines, FIG. 8 also showing a secondary use position adjacent the dental chair when the dental chair is upright.
Figure 9:
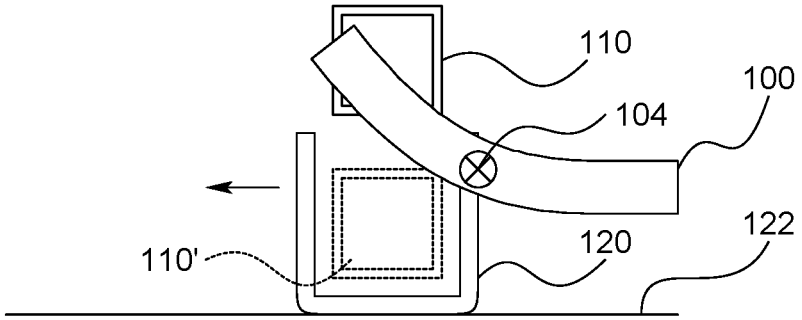
Figure 10:
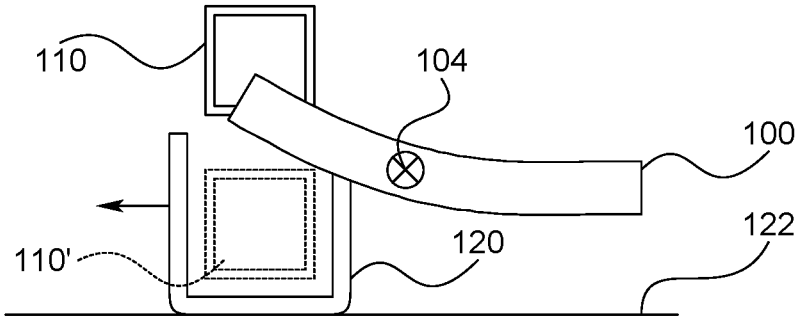
Figure 11:
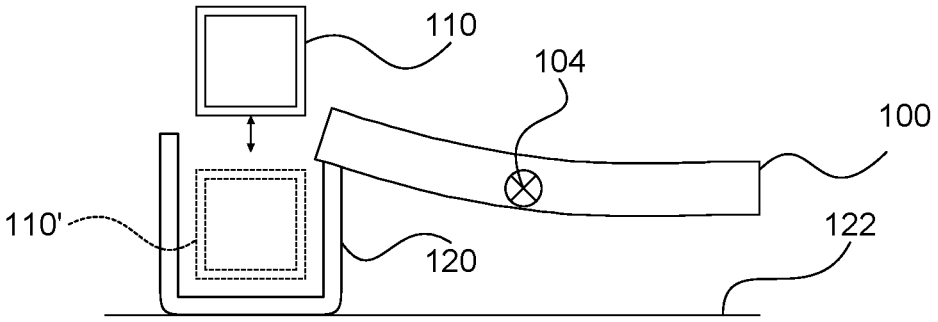
Figure 12:
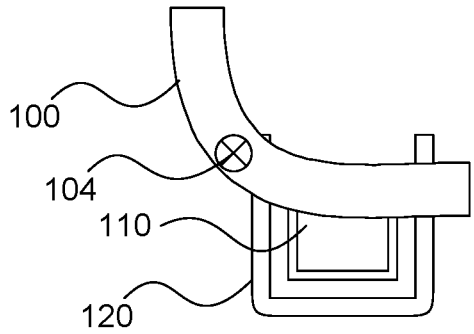
FIGS. 12-15 are side views of a dental chair and a single technology, the single technology moving from a storage position (FIG. 12) when the dental chair is upright to a use position (FIG. 15) adjacent the dental chair when the dental chair is reclined.
Figure 13:
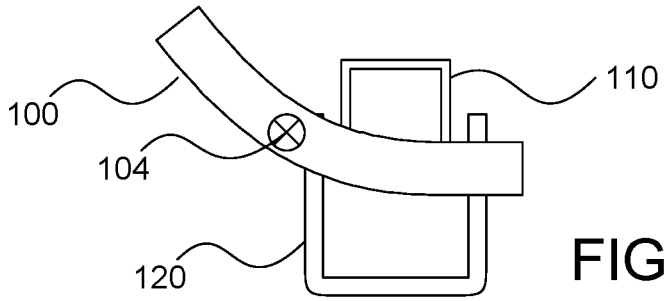
Figure 14:
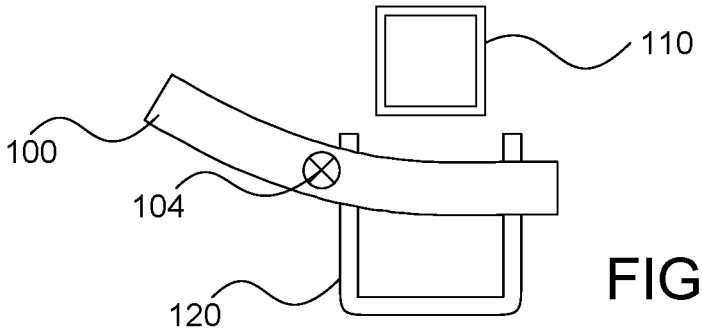
Figure 15:
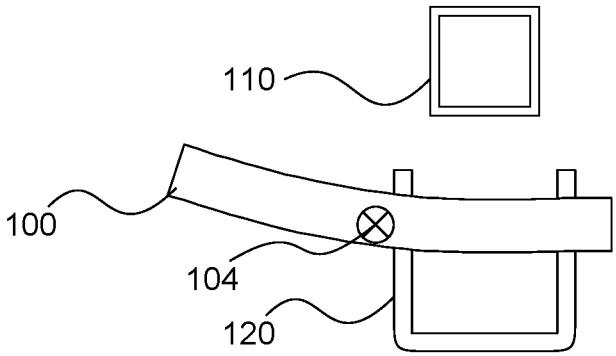

Turning to the exemplary system shown in FIGS. 8-11, this system is shown as including a dental chair 100 and a single technology 110. The single technology 110 moves from a storage position (FIG. 8) to a primary use position (FIG. 11) behind the dental chair 100 as the dental chair 100 reclines. In addition, the single technology 110 moves from a use position (FIG. 11) to a storage position (FIG. 8) as the dental chair 100 returns to an upright position. FIG. 8 also showing a secondary use position adjacent the dental chair 100 when the dental chair 100 is upright. Put another way, there is at least one practitioner use position and at least one patient use position. In this example, there are three movements (which may be individually or jointly implemented automatically and/or manually): traveling, positioning, and orientating (FIGS. 45-47 and FIGS. 48-50). In this exemplary system, a dental practitioner 112 would preferably activate the system using an actuator 104. After activation, the technology 110 travels from a first location (shown as adjacent to the dental chair 100) to a second location behind the dental chair 100. The technology 110 also transitions from within the container 120 (a storage position) to outside of the container 120 (a use position). The container 120 may be a different type of container, may be a sterilizing container, or may be omitted. The technology 110 may also be oriented to almost any desired orientation as shown in FIGS. 45-47 and FIGS. 48-50. One distinction between the system of the FIGS. 8-11 and the system of FIGS. 4-7 is that the technology 110 can move between the storage position (shown as technology 110' when it is in the container 120) and the use position before, during, or after the technology 110 has traveled to its desired location. Using the actuator, the technology 110 may be returned to its original configuration or another configuration.

Turning to the exemplary system shown in FIGS. 12-15, this system is shown as including a dental chair 100 and a single technology 110. The single technology 110 moving from a storage position (FIG. 12) when the dental chair 100 is upright to a use position (FIG. 15) adjacent the dental chair 100 when the dental chair 100 is reclined. In addition, the single technology 110 moves from a use position (FIG. 15) to a storage position (FIG. 12) as the dental chair 100 returns to an upright position. Put another way, the position of the technology 110 is inverse to the position of the dental chair 100 in that when the technology is "up" the chair is "down," and when the technology is "down" the chair is "up." In this example, there are two movements (which may be individually or jointly implemented automatically and/or manually): positioning and orientating (FIGS. 45-47 and FIGS. 48-50). In this exemplary system, a dental practitioner 112 would preferably activate the system using an actuator 104. After activation, the technology 110 transitions from within the container 120 (a storage position) to outside of the container 120 (a use position). The container 120 may be a different type of container, may be a sterilizing container, or may be omitted. The technology 110 may also be oriented to almost any desired orientation as shown in FIGS. 45-47 and FIGS. 48-50. Using the actuator, the technology 110 may be returned to its original configuration or another configuration.

Turning to the exemplary system shown in FIGS. 16-17, this system is shown as including a dental chair 100 and a single technology 110 adjacent the dental chair 100. The single technology 110 is movable between a storage position and a use position (FIG. 16) when the dental chair 100 is upright, and between a storage position and a use position (FIG. 17) when the dental chair 100 is reclined. In this example, there are two movements (which may be individually or jointly implemented automatically and/or manually): positioning and orientating (FIGS. 45-47 and FIGS. 48-50). This system is similar to the system shown in FIGS. 12-15 (and the disclosure is incorporated here without repetition) except that the technology 110 can move between the storage position (shown as technology 110' when it is in the container 120) and the use position before, during, or after the dental chair 100 is reclined or upright. Put another way, in FIGS. 16-17 the technology 110 can be in any position (or orientation) when the dental chair 100 is in any configuration.

Turning to the exemplary system shown in FIGS. 18-19, this system is shown as including a dental chair 100 and a single technology 110 behind the dental chair 100. The single technology 110 is movable between a storage position and a use position (FIG. 18) when the dental chair 100 is upright, and between a storage position and a use position (FIG. 19) when the dental chair 100 is reclined. In this example, there are two movements (which may be individually or jointly implemented automatically and/or manually): positioning and orientating (FIGS. 45-47 and FIGS. 48-50). This system is similar to the system shown in FIGS. 16-17 (and the disclosure is incorporated here without repetition) except that the technology 110 is located behind the dental chair 100. A variation on the system of FIGS. 18 and 19 would allow the technology 110 to travel. Such a variation of the system could include a storage position that is under the floor, at or near the ceiling, or against a wall.

Figure 20:
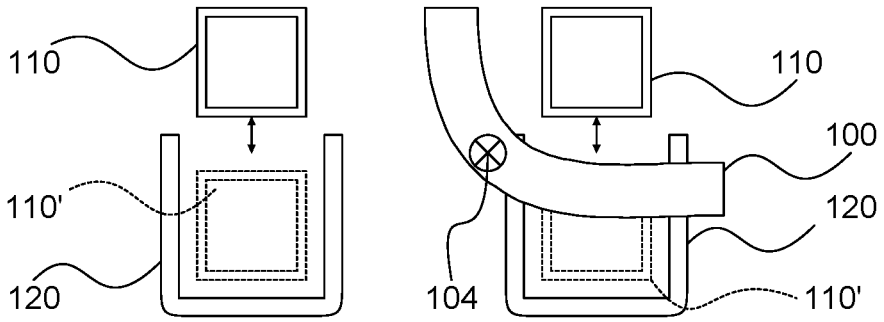
FIGS. 20-21 are side views of a dental chair and two technologies, a first technology behind the dental chair and a second technology adjacent the dental chair, the technologies independently movable between a storage position and a use position (FIG. 20) when the dental chair is upright, and between a storage position and a use position (FIG. 21) when the dental chair is reclined.
Figure 21:
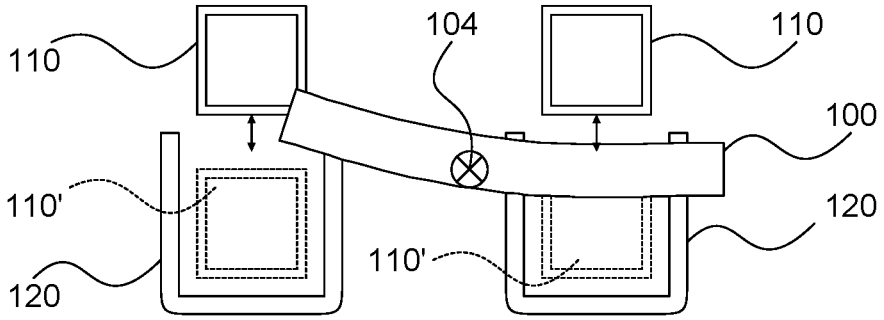

Turning to the exemplary system shown in FIGS. 20-21, this system is shown as including a dental chair 100 and two technologies, a first technology 110 behind the dental chair 100 and a second technology 110 adjacent the dental chair 100. In this example, both technologies 110 have two movements (which may be individually or jointly implemented automatically and/or manually): positioning and orientating (FIGS. 45-47 and FIGS. 48-50). The technologies 110 are preferably independently movable between a storage position (the technology shown as technology 110') and a use position when the dental chair 100 is upright (FIG. 20), and between a storage position and a use position when the dental chair 100 is reclined (FIG. 21). Put another way, the system of FIGS. 20-21 includes both the system of FIGS. 16-17 (and the disclosure is incorporated here without repetition) and the system of FIGS. 18-19 (and the disclosure is incorporated here without repetition).

Turning to the exemplary system shown in FIGS. 22-23, this system is shown as including a dental chair 100 and a single alternatively situated technology 110 behind the dental chair 100. As shown, the technology 110 is alternatively situated because the container 120 is attached to the back of the dental chair 100. (This position can also be described as "behind" or "under" the furniture, although other behind positions or under positions are possible and could be considered to be alternative situations. For example, the technology could be under the seat of the dental chair when the dental chair is in the upright position.) The shown exemplary attachment has the technology 110 parallel to the back of the dental chair 100. Other alternatively situated technologies could be in other places including, but not limited to within the dental chair, under the seat of the chair, or other situation not previously described. In this example, there are two movements (which may be individually or jointly implemented automatically and/or manually): positioning and orientating (FIGS. 45-47 and FIGS. 48-50). The single alternatively situated technology 110 is in a storage position (FIG. 22) when the dental chair 100 is upright. (Although not shown, the single alternatively situated technology 110 could be movable between a storage position and a use position when the dental chair 100 is upright.) The single alternatively situated technology 110 is movable between a storage position (shown as technology 110') and a use position (FIG. 23) when the dental chair 100 is reclined. The movement of both the technology 110 and the dental chair 100 may be actuated using an actuator 104. The container 120 may be a different type of container, may be a sterilizing container, or may be omitted. The technology 110 may also be oriented to almost any desired orientation as shown in FIGS. 45-47 and FIGS. 48-50.

Turning to the exemplary system shown in FIGS. 24-25, this system is shown as including a dental chair 100 and two technologies, a first alternatively situated technology 110 behind the dental chair 100 and a second technology 110 adjacent the dental chair 100. In this example, both technologies 110 have two movements (which may be individually or jointly implemented automatically and/or manually): positioning and orientating (FIGS. 45-47 and FIGS. 48-50). The first alternatively situated technology 110 of FIGS. 24-25 is substantially the same as the alternatively situated technology 110 of FIGS. 22-23 (and the disclosure is incorporated here without repetition). The second technology 110 of FIGS. 24-25 is substantially the same as the technology 110 of system of FIGS. 16-17 (and the disclosure is incorporated here without repetition). The technologies 110 are preferably independently movable. The movement of the technologies 110 and the dental chair 100 may be actuated using an actuator 104.

For some or all of these systems, the movement of the technology 110 may be coordinated with the transition between the upright position of the dental chair 100 and the recline position of the dental chair 100. For example in FIGS. 4-7 the technology 110 moves from a storage position (FIG. 4) to a use position (FIG. 7) behind the dental chair 100 as the dental chair 100 reclines, and from a use position (FIG. 7) to a storage position (FIG. 4) as the dental chair 100 returns to an upright position. Although some variations may allow independent movement of the technology, all of the variations could be programmed to have at least some of the movements of the technology 110 may be coordinated with the transition between the upright position of the dental chair 100 and the recline position of the dental chair 100.

Container and Sterilizer

Figure 26:
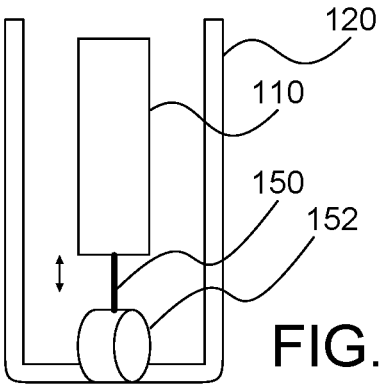
FIGS. 26-29 are end views of a technology and a container, the technology moving between a storage position (FIG. 26) when the technology is positioned within the container, and a use position (FIG. 29) when the technology is accessible (outside of the container).
Figure 27:
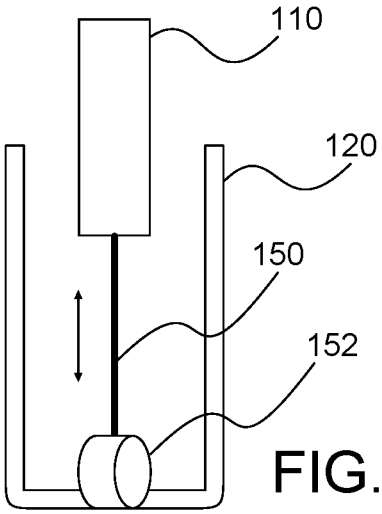
Figure 28:
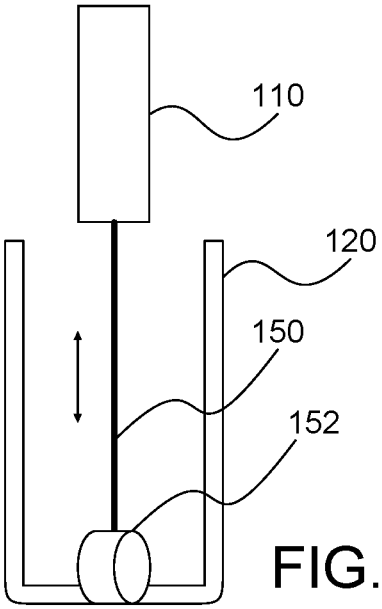
Figure 29:
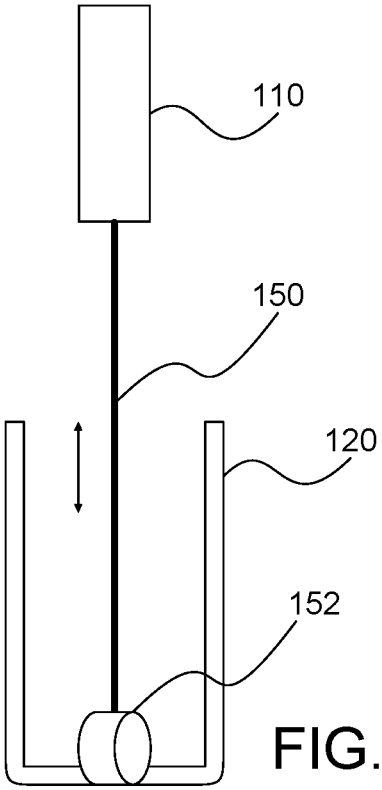

FIGS. 26-29 show end views of a generic container 120. Many of the other figures show the positioning of the technology 110, but do not provide specifics on how the technology 110 transitions between positions. FIGS. 26-29 show an example of how the technology 110 moves between a storage position (FIG. 26) (when the technology 110 is positioned within the container 120) and a use position (FIG. 29) (when the technology 110 is accessible—outside of the container 120). In addition, the technology 110 moves from a use position (FIG. 29) to a storage position (FIG. 26). The movement may be implemented automatically and/or manually. These figures also show an exemplary interconnection flexible rod 150 that can be wound (in a manner similar to the "tape" of a tape measurer) in a housing 152. (If cables are needed, the actual implementation may be a moving cable track.) The interconnection flexible rod 150 winds out of the housing 152 as the technology 110 extends out of the container 120. The interconnection flexible rod 15 winds into the housing 152 as the technology 110 enters the container 120. Other interconnection rods including, but not limited to, the telescoping interconnection rod 190 of FIGS. 45-47 and FIGS. 48-50, may be used instead of the interconnection flexible rod 150. Although the interconnection flexible rod 150 and housing 152 are shown as originating from within the container, unless specifically claimed, this configuration is only meant to be exemplary. For example, other interconnections could originate from outside of the container 120.

Figure 30:
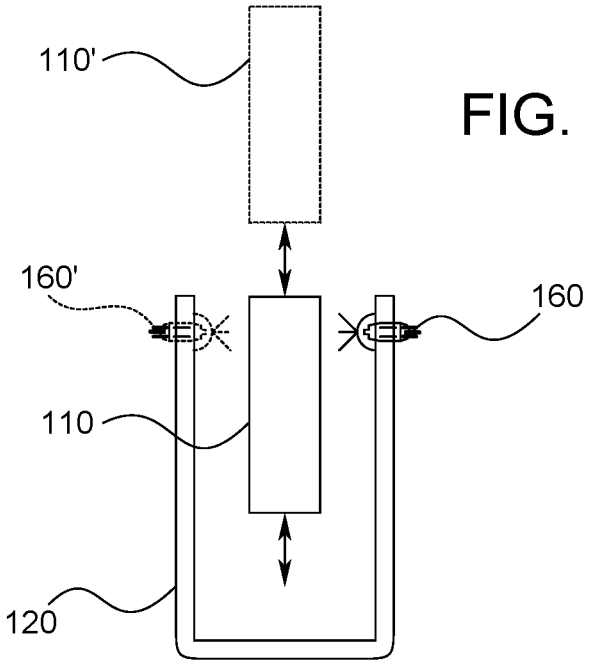
FIG. 30 is an end view of a first exemplary sterilization system in which at least one face of a technology is sterilized using UV light as the technology moved from a use position to a storage position and/or when the technology moved from a storage position to a use position.

FIG. 30 is an end view of a first exemplary sterilization system in which at least one face of a technology 110 is sterilized using "invisible" sterilizing means (shown and discussed as UV light 160). As shown, the technology 110 may be sterilized as it moves from a use position to a storage position and/or when the technology 110 moves from a storage position to a use position. As shown, the UV light 160 is positioned to expose at least one face of the technology 110 to sterilization. A second UV light 160' may be positioned to expose the opposite side of the technology 110 to sterilization. Additional UV lights may be positioned to expose additional surfaces of the technology 110 to sterilization. If there are enough UV lights to expose all the desired surfaces of the technology simultaneously, the sterilization could take place when the technology is completely contained within the container (instead of or in addition to when the technology is entering and/or leaving the container). The UV light may be, for example, similar to the technology disclosed in U.S. Pat. No. 6,458,331 to Roberts or other references disclosed herein. Although shown as UV light, other "invisible" sterilizing means may include other types of sterilizing including, but not limited to other light-based sterilization, wave-based sterilization, temperature (e.g. heat) sterilization, and/or other means for sterilizing known or yet to be discovered. It should be noted that the description of the sterilizing systems of U.S. Pat. No. 6,278,122 to Gagnon, U.S. Pat. No. 8,597,569 to Gruen et al., and U.S. Pat. No. 8,597,569 to Gruen et al. are incorporated herein by reference and may be modifiable to be alternative systems for sterilizing the technology.

Figure 31:
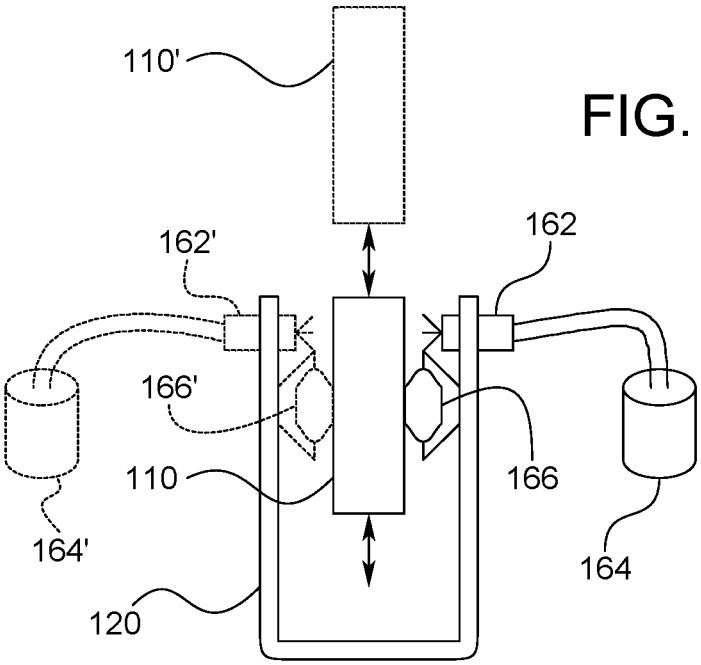
FIG. 31 is an end view of a second exemplary sterilization system in which at least one face of a technology is sterilized using a sterilization agent as the technology moved from a use position to a storage position and/or when the technology moved from a storage position to a use position.

FIG. 31 is an end view of a second exemplary sterilization system in which at least one face of a technology 110 is sterilized using chemical sterilizing means (shown and discussed as sterilizing agent applied using sprayer 162) that is sterilized as it is sprayed using a sprayer 162. The sterilizing agent may be held in a reservoir 164, 164'. Although shown as a separate reservoir for each sprayer, fewer reservoirs may be used if multiple sprayers are plumbed to a single reservoir. As shown, the technology 110 may be sterilized as it moves from a use position to a storage position and/or when the technology 110 moves from a storage position to a use position. As shown, the sprayer 162 is positioned to expose at least one face of the technology 110 to sterilization. A second sprayer 162' may be positioned to expose the opposite side of the technology 110 to sterilization. One or more drying wipers 166, 166' (which may be replaceable absorbent rollers) may be positioned to wipe the surface of the technology dry. The sterilizing may be accomplished in a series of steps that can be thought of as "spray, delay, and wipe." For example, there may be a series of six (or any number) 10 second (or any amount of time) steps in which the technology pauses as it enters the container. In the first step, the first $1/5^{th}$ of the technology may be sprayed. In the second step, the second $1/5^{th}$ of the technology is sprayed while the first $1/5^{th}$ is wiped dry. This continues as the technology moves into the container until the sixth step when the last $1/5^{th}$ of the technology is wiped dry. Such a series of steps would take one minute if each step took 10 seconds. Additional sprayers (and optionally reservoirs and/or drying wipers) may be positioned to expose additional surfaces of the technology 110 to sterilization. If there are enough sprayers (and optionally reservoirs and/or drying wipers) to expose all the desired surfaces of the technology simultaneously, the sterilization could take place when the technology is completely contained within the container (instead of or in addition to when the technology is entering and/or leaving the container). Although shown as a generic sterilizing agent, for purposes of enablement, the sterilizing agent may be alcohol, hydrogen peroxide, peracetic acid, disinfectants, steam, vapor, and/or other sterilizing agents known or yet to be discovered. Although shown as generic sprayers, for purposes of enablement, the sprayers may be any type of sprayers known or yet to be discovered that are capable of spraying the chemical agent in the desired pattern, concentration, and velocity. The sterilizing agent may also be applied using one or more cloth or wipe as the applicator instead of or in addition to the sprayer(s).

Figure 35:
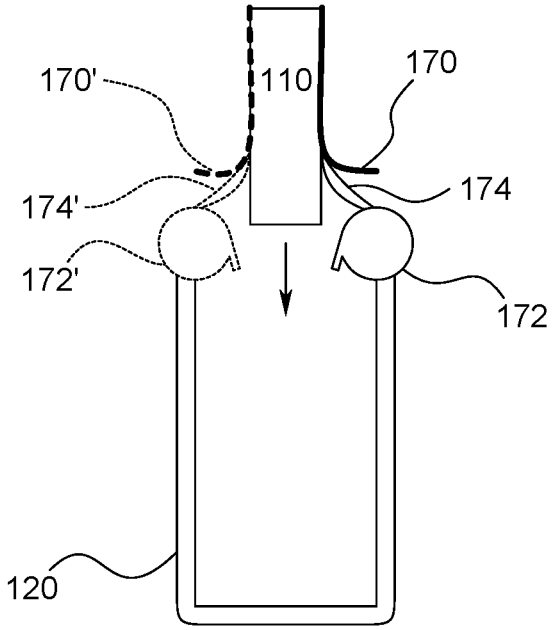
Figure 36:
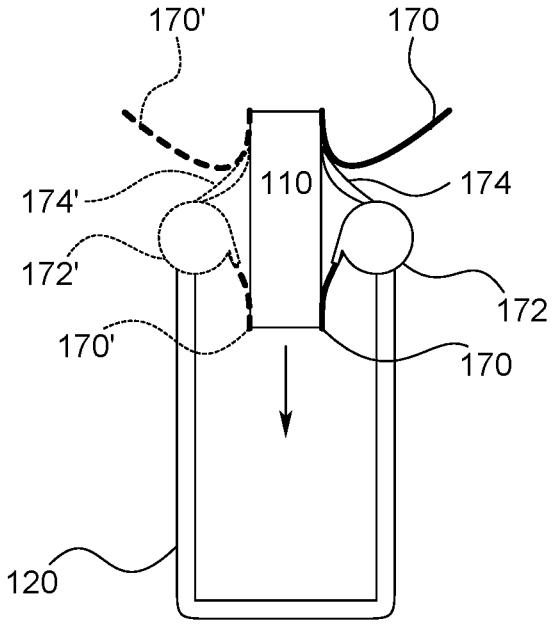

FIGS. 32-36 are end views of a third exemplary sterilization system in which at least one face of a technology 110 is sterilized using a sterilized coating or sheet 170, 170'. FIGS. These figures show steps in a progression of the technology 110 entering the container 120 (entering a storage position) as shown in FIG. 32, positioned within the container 120 (storage position) as shown in FIG. 33, just leaving the container 120 as shown in FIG. 34, beginning to return to the container 120 as shown in FIG. 35, and continuing to return to the container 120 as shown in FIG. 36. The next step after FIG. 36 would be FIG. 32. In the shown system, the sterilized coating(s) or sheet(s) 170, 170' is/are applied by applicator(s) 172, 172' as the technology 110 enters the container 120 (FIG. 36 and FIG. 32). The shown system also shows the contaminated coating(s) or sheet(s) 170, 170' being removed by remover(s) 172, 172' (which may be a blade or scraper) as the technology 110 enters the container 120 (FIG. 35 and FIG. 36). On the other hand, the shown system also leaves the coating(s) or sheet(s) 170, 170' unmolested as the technology 110 leaves the container 120 (FIG. 32 and FIG. 33). Although the shown series sterilizes the technology as it moves from a use position to a storage position, it could also be reversed such that the technology is sterilized as it moves from a storage position to a use position. As shown, the applicator 172 is positioned to apply a coating or sheet 170 to at least one face of the technology 110 to sterilization. A second applicator 172' may be positioned to apply a coating or sheet 170 to the opposite side of the technology 110. Alternatively, the coatings or sheets may be a bag that simultaneously covers multiple surfaces of the technology 110. The coating(s) or sheet(s) may be made from any material that is sterile, able to removably adhere (or be held to) to the surface(s) of the technology, and allows a user to use the technology with the coating(s) or sheet(s) thereon. Such coatings or sheets could be thought of as a removable, sterilized screen protector. The material may be any material known or yet to be discovered having the appropriate properties. It should be noted that the description of the system and method for sanitizing touch screens of U.S. Pat. No. 8,753,571 to Hsu et al. is incorporated herein by reference and may be modifiable to be an alternative system for sterilizing the technology.

It should be noted that a combination of sterilization apparatus and techniques could be used. For example, after a coating or sheet is removed, the exposed surface could be sprayed with a chemical sterilizer. It should also be noted that sterilizing techniques that would damage the technology would not be used in the present system.

Containerless Variations of the Technology Associated Furniture System

Figure 37:
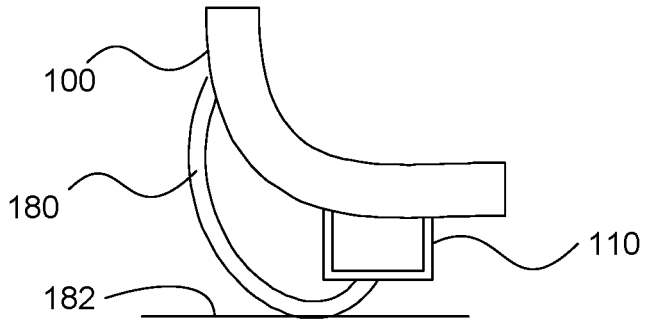
FIGS. 37-40 are side views showing a very basic floor-mounted interconnection between a dental chair and technology as they move between respective configurations.
Figure 38:
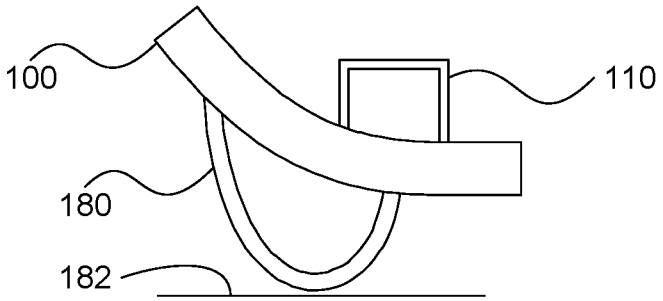
Figure 39:
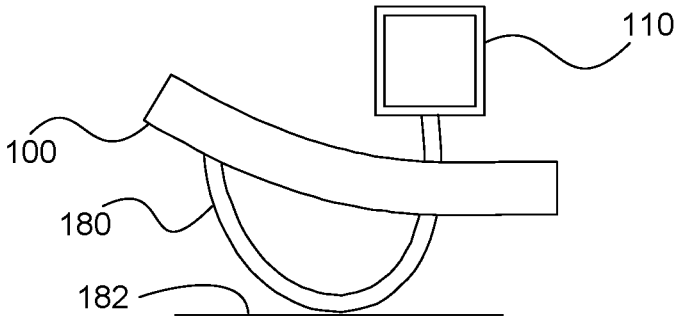
Figure 40:
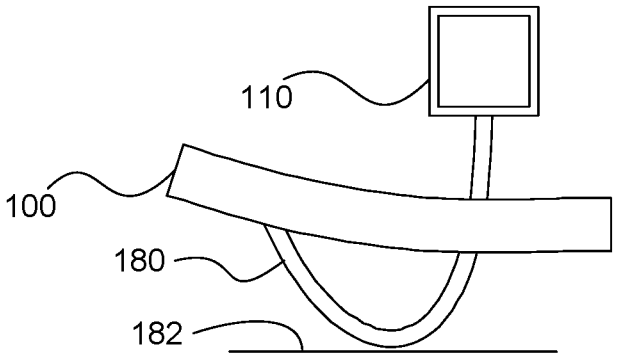

FIGS. 37-40 are side views showing a very basic floor-mounted interconnection 180 between a dental chair 100 and technology 110 as they move between respective configurations. The shown system moves between an upright dental chair 100 with the technology 110 in a storage position (in this case, out of the way, but without a container) as shown in FIG. 37 to a reclining dental chair 100 with the technology 110 in a use position. As the dental chair moves to an upright position, the technology would return to the storage position. Put another way, the position of the technology 110 is inverse to the position of the dental chair 100 in that when the technology is "up" the chair is "down," and when the technology is "down" the chair is "up." In the shown system, the use position is a patient use position. By reversing the direction of the interconnection 180, the use position could be a practitioner position. Once in the use position, the technology could be oriented using orienting structure such as that shown in FIGS. 45-47 and FIGS. 48-50. The interconnection 180 may be, for example, flexible, articulated, and/or telescoping. The interconnection 180 may be assisted by a track or rail 182 that allows additional movement of the interconnection 180 and may allow the technology 110 to travel between locations as well as positions.

Figure 41:
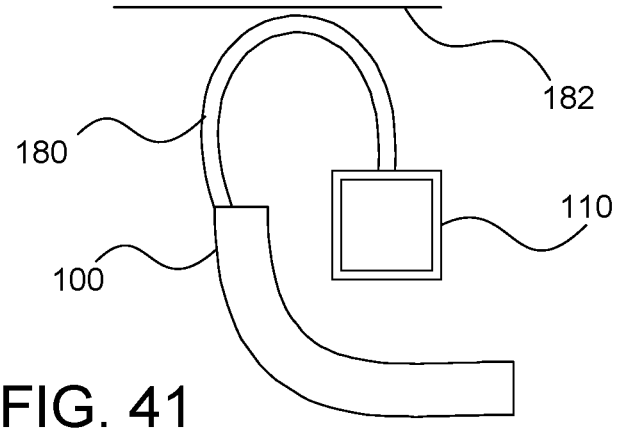
FIGS. 41-44 are side views showing a very basic ceiling-mounted interconnection between a dental chair and technology as they move between respective configurations.
Figure 42:
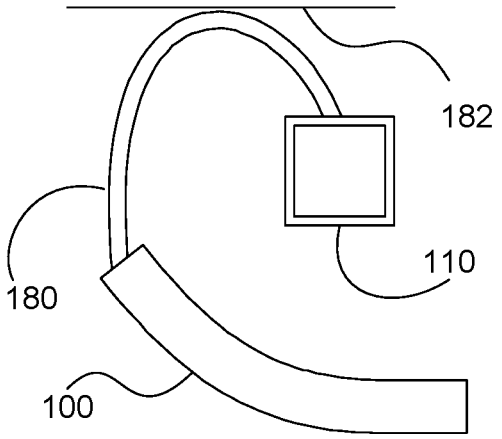
Figure 43:
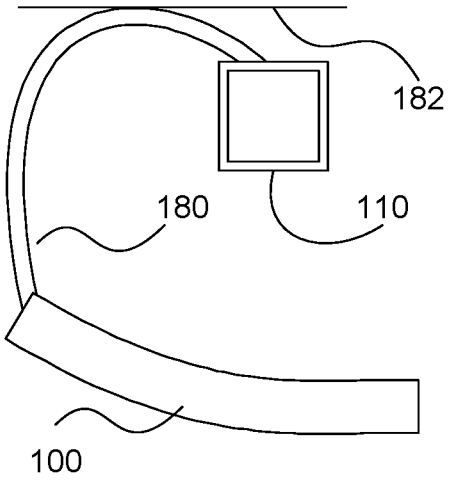
Figure 44:
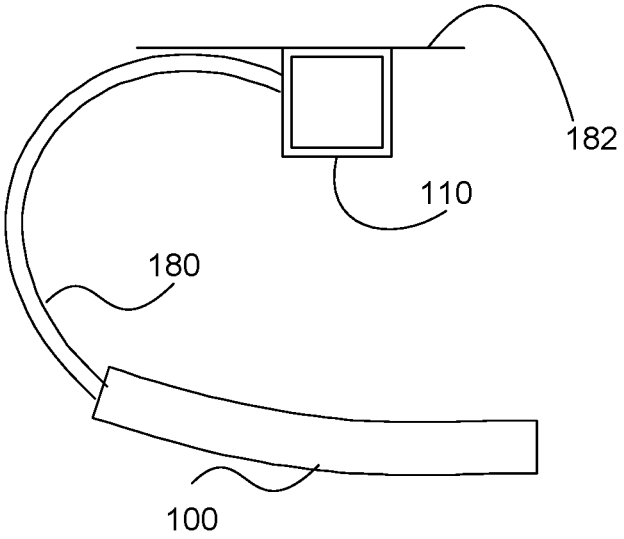

FIGS. 41-44 are side views showing a very basic ceiling-mounted interconnection 180 between a dental chair 100 and technology 110 as they move between respective configurations. The shown system moves between an upright dental chair 100 with the technology 110 in a use position as shown in FIG. 41 to a reclining dental chair 100 with the technology 110 in a storage position (in this case, out of the way, but without a container). Although the technology's position on the ceiling may be considered a storage position, because the patient is lying on his back, it might be a second use position if the patient can see the technology. As the dental chair moves to an upright position, the technology would return to the use position. In the shown system, the use position is a patient use position. Once in the use position, the technology could be oriented using orienting structure such as that shown in FIGS. 45-47 and FIGS. 48-50. The interconnection 180 may be, for example, flexible, articulated, and/or telescoping. The interconnection 180 may be assisted by a track or rail 182 that allows additional movement of the interconnection 180 and may allow the technology 110 to travel between locations as well as positions.

For these shown containerless systems, the movement of the technology 110 is essentially coordinated with the transition between the upright position of the dental chair 100 and the recline position of the dental chair 100. Theoretically, there could be a way to disconnect the technology from the dental chair 100 to allow for independent movement therebetween.

Although not shown, the alternatively situated technology 110 of FIGS. 22-23 and FIGS. 24-25 could be a containerless system in which the technology 110 is associated with the back of the dental chair 100 (or some other location) using, for example, at least one track, rail, or interconnection rod to facilitate movement between positions.

Orientation

FIGS. 45-47 and FIGS. 48-50 show the infinite range in orientations that would be available using, for example, a multi-orientational connector 192 such as a ball joint. The virtually unlimited orientations would allow a user to customize his desired orientation. Some or all of the movement may be performed manually, automatically, and/or a hybrid/combination of manually and automatically. It should be noted that although the multi-orientational connector 192 is shown as being integral with the technology 110, the multi-orientational connector 192 may be attached to the technology 110 (e.g. using a mounting bracket, suction cup, screws, adhesive, or other known or yet to be discovered attachment means). Although not shown, a cradle may be used in which the multi-orientational connector is integrated.

Figure 45:
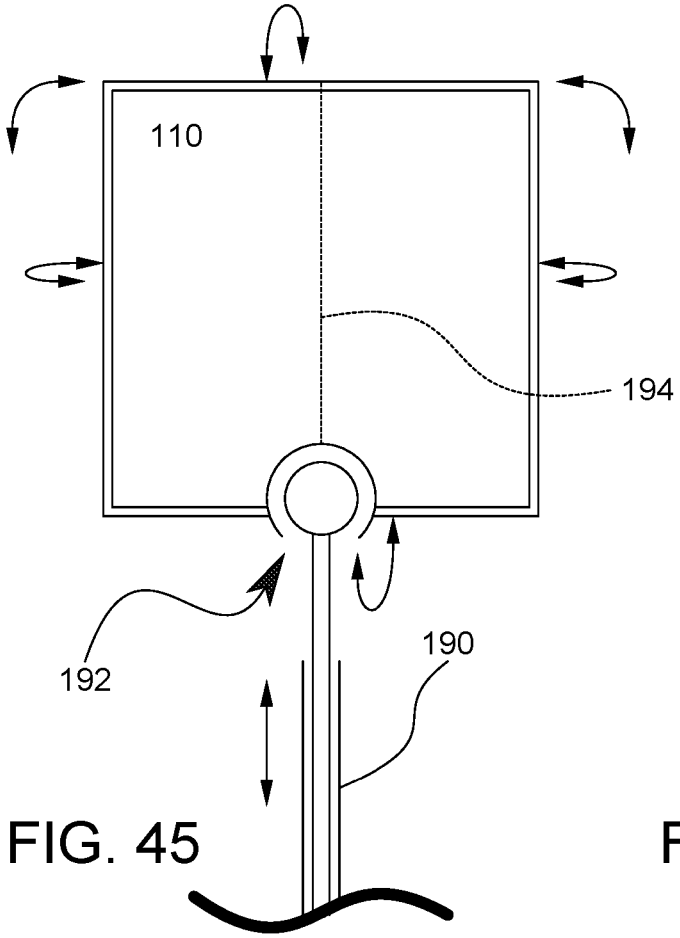
FIG. 45 is a first view of a technology attached to an interconnection rod via a multi-orientational connector, the connector situated toward an edge of the technology.
Figure 46:
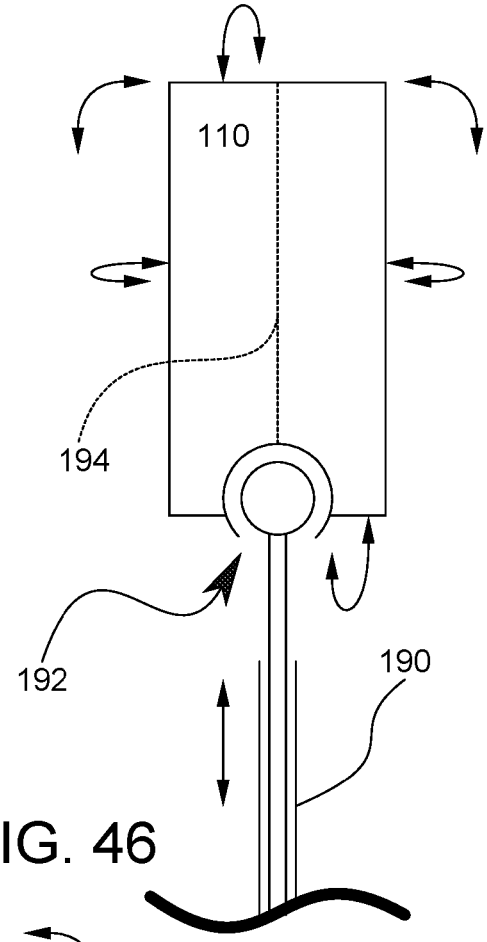
FIG. 46 is a second view of the technology attached to the interconnection rod via the multi-orientational connector shown in FIG. 45, the orientation shown in the second view being perpendicular along an axis from the orientation shown in the first view.
Figure 47:
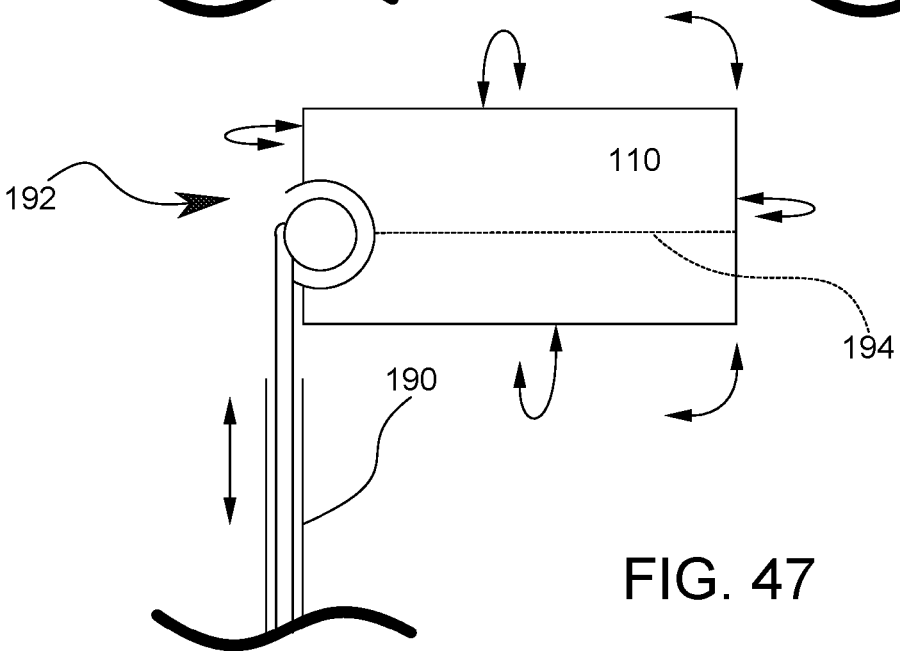
FIG. 47 is a third view of the technology attached to the interconnection rod via the multi-orientational connector shown in FIG. 45 and FIG. 46, the orientation shown in the third view being perpendicular to the orientations shown in the first view and the second view.

In FIGS. 45-47 the multi-orientational connector 192 is situated toward an edge of the technology 110. FIG. 45 is a first view showing a face (e.g. the front face or the back face) of a technology 110. The technology 110 is attached to a telescoping interconnection rod 190 via a multi-orientational connector 192. Bisecting the face is a virtual axis 194 that is shown as extending the line of the telescoping interconnection rod 190. FIG. 46 is a second view showing the edge of the technology 110. The second view is basically a rotation along the axis 194 such that the orientation shown in the second view is perpendicular to the orientation shown in the first view. FIG. 47 is a third view of the technology 110. The third view shows the rotated technology being in an orientation perpendicular to the orientations shown in the first view and the second view. Although only three orientations are shown, the actual available orientations would be virtually infinite.

Figure 48:
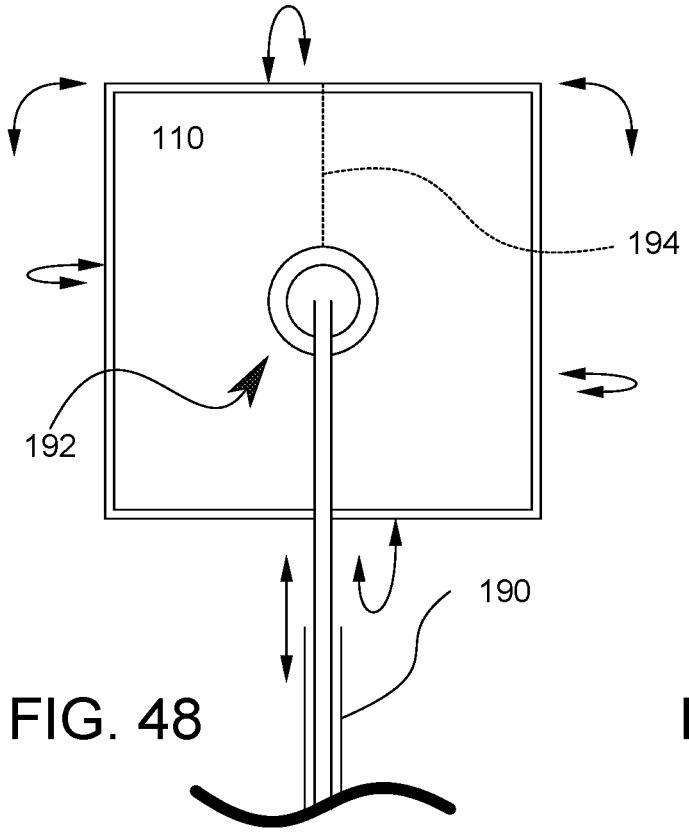
FIG. 48 is a first view of a technology attached to an interconnection rod via a multi-orientational connector, the connector situated on a face of the technology.
Figure 49:
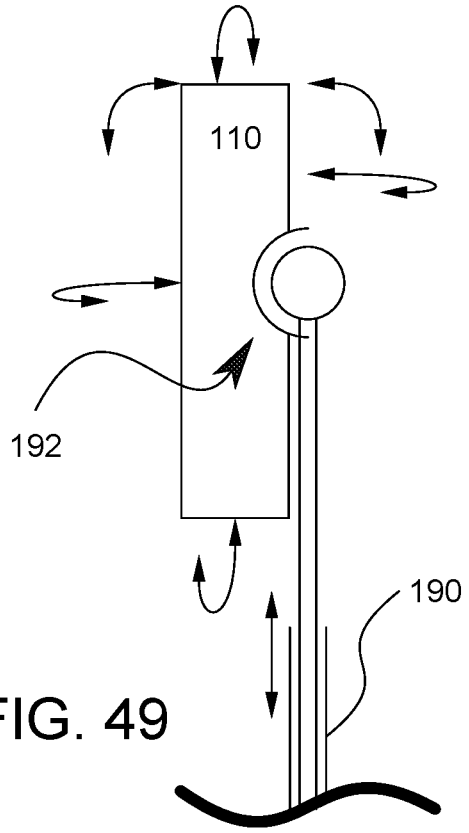
FIG. 49 is a second view of the technology attached to the interconnection rod via the multi-orientational connector shown in FIG. 48, the orientation shown in the second view being perpendicular along an axis from the orientation shown in the first view.
Figure 50:
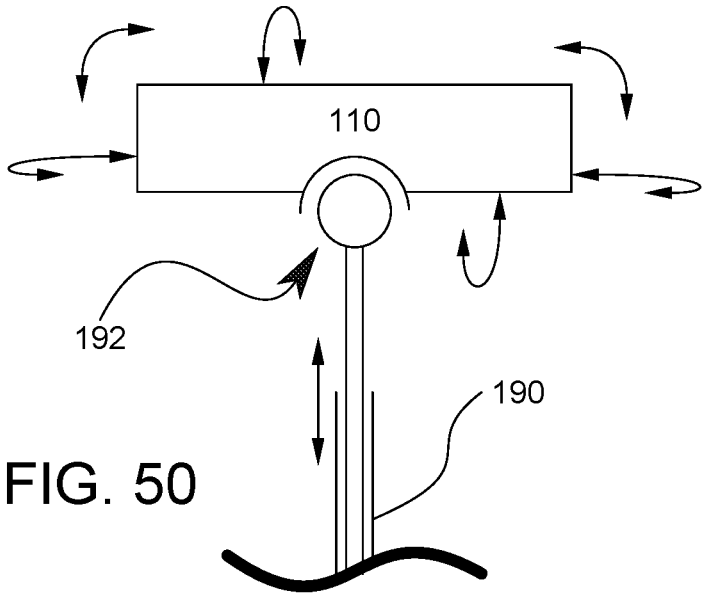
FIG. 50 is a third view of the technology attached to the interconnection rod via the multi-orientational connector shown in FIG. 48 and FIG. 49, the orientation shown in the third view being perpendicular to the orientations shown in the first view and the second view.

In FIGS. 48-50 the multi-orientational connector 192 is situated on a face of the technology 110. FIG. 48 is a first view showing a face (e.g. the back face) of a technology 110. The technology 110 is attached to a telescoping interconnection rod 190 via a multi-orientational connector 192. Bisecting the face is a virtual axis 194 that is shown as extending the line of the telescoping interconnection rod 190. FIG. 49 is a second view showing the edge of the technology 110. The second view is basically a rotation along the axis 194 such that the orientation shown in the second view is perpendicular to the orientation shown in the first view. FIG. 50 is a third view of the technology 110. The third view shows the rotated technology being in an orientation perpendicular to the orientations shown in the first view and the second view. Although only three orientations are shown, the actual available orientations would be virtually infinite.

Control Systems

The exemplary components and/or subsystems described herein, if they are all or partially automated, may require control. For example, the movement of the technology may require a movement control subsystem (or separate movement control subsystems for location control, position control, and/or orientation control). The configuration(s) of the dental chair (e.g. upright or reclined) may require a chair control subsystem. In addition, a sterilization unit may require a sterilization control subsystem.

Control subsystems may be similar to control subsystems for known systems, although they may be combined in unique ways. For example, the movement control subsystem (or separate movement control subsystems for location control, position control, and/or orientation control) may be similar to movement control subsystems used for locating, positioning, and oriented an automated car seat. For example, the automated car seat is able to move the car seat along a track, position the car seat, and orient (e.g. tilt) the car seat. Also like an automated car seat, the movement control subsystem can store the precise use location, position, and/or orientation of the technology(s) and/or dental chair for multiple users (e.g. the patient 102 or the practitioner 112, 112"). The control of known dental chairs is well known (and patents disclosed in the background are incorporated by reference herein). Similarly, the sterilization control subsystem may be modeled after known sterilization subsystems.

Figure 51:
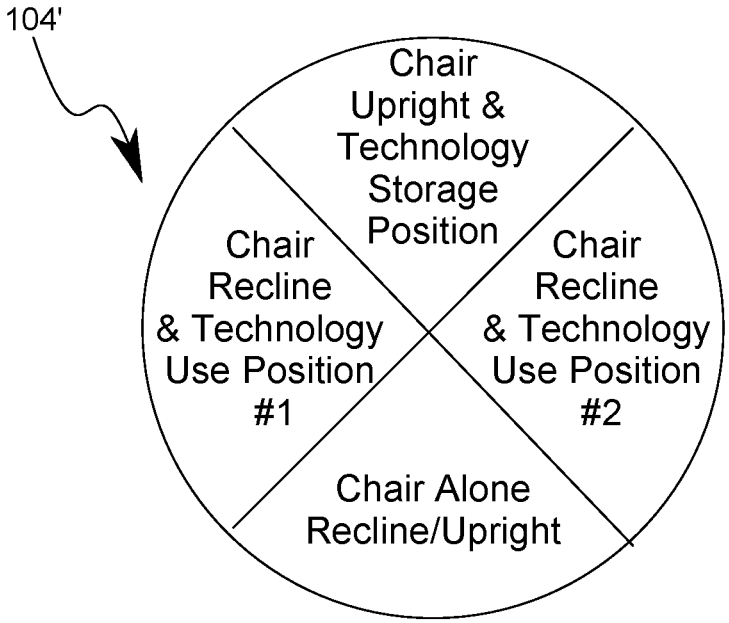
FIG. 51 is an enlarged view of an exemplary actuator for actuating the configuration of a dental chair and a single technology that has two predetermined use positions.
Figure 52:
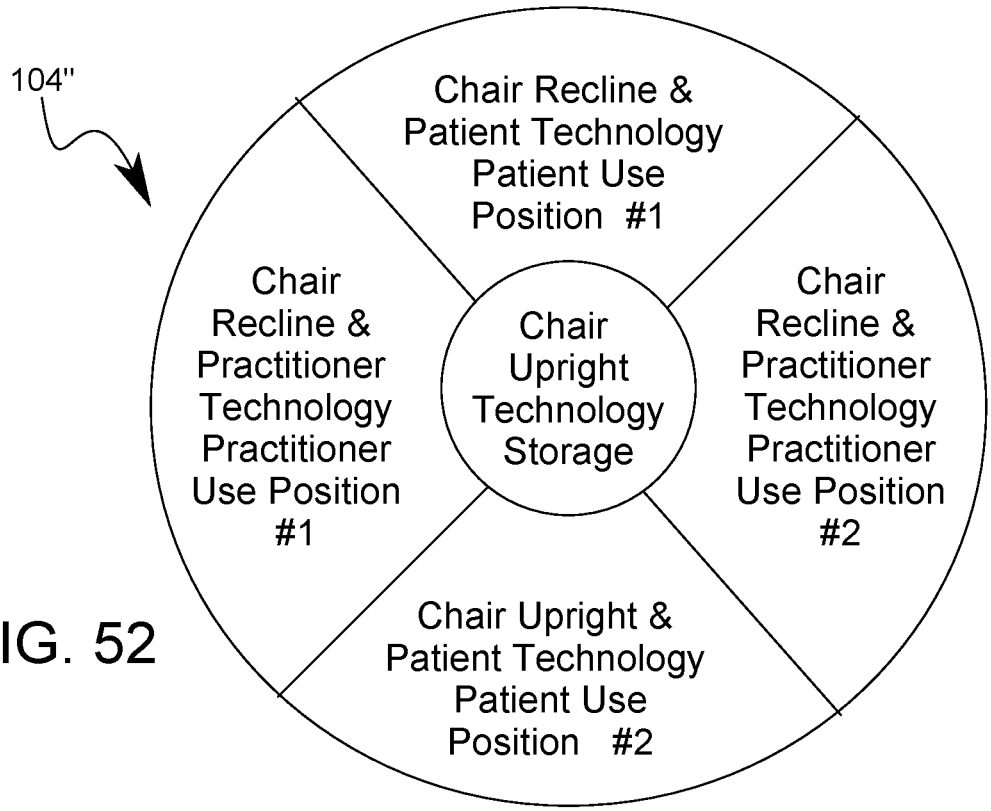
FIG. 52 is an enlarged view of an exemplary actuator for actuating a dental chair and two technologies, the patient technology having two use positions and the practitioner technology having two use positions.

For purposes of completeness, applicant has shown an exemplary actuator 104 in many of the figures. Specific exemplary actuators 104' and 104" are shown in FIG. 51 and FIG. 52. More specifically, FIG. 51 shows an enlarged exemplary actuator 104' for actuating the configuration of a dental chair and a single technology that has two predetermined use positions. As shown, there is a button for actuating the chair alone (pushing the button moves the chair alone between recline and upright), there is a button for both uprighting the chair and returning the technology to the storage position, and there are two buttons that recline the chair and put the technology into the use position (one button for use position #1 and one button for use position #2). It should be noted that use position #1 and use position #2 may be two different practitioner use positions, two different patient use positions, or one practitioner use position and one patient use position. FIG. 52 shows an enlarged exemplary actuator 104" for actuating a dental chair and two technologies (one patient technology and one practitioner technology), the patient technology having two use positions and the practitioner technology having two use positions. As shown, there is a button for both uprighting the chair and returning the technologies to their respective storage positions, there is a button for reclining the chair and putting the patient technology into patient use position #1, there is a button for uprighting the chair and putting the patient technology into patient use position #2, and there are two buttons that recline the chair and put the practitioner technology into the practitioner use position (one button for practitioner use position #1 and one button for practitioner use position #2). These actuators 104' and 104" are meant to be exemplary and, unless claimed, are not meant to limit the scope of the invention. Alternative actuators may include a button for actuating sterilization. Alternatively, the sterilizing may be automatic or associated with other buttons (e.g. when the button for both uprighting the chair and returning the technologies to their respective storage positions is activated, the sterilization is also activated). Alternative actuators may include separate buttons (or other controls) for controlling the chair, locating the technology(s), positioning the technology(s), orienting the technology(s), actuating sterilizing, or otherwise actuating and/or controlling the entire system and/or components of the system. These actuators may be predetermined (e.g. at the factory) and/or may be programmed by the user.

Some of the physical control elements are shown and discussed herein. For example, tracks or rails 122, 182 are shown in FIGS. 4-7, FIGS. 8-11, FIGS. 37-40, and FIGS. 41-44. The shown tracks or rails 122, 182 guide the location of the technology 110. Also shown are interconnections 180 (FIGS. 37-40 and FIGS. 41-44) between the dental chair 100 and the technology 110. The interconnections 180 cause the technology 110 to move in relation to the movement of the dental chair 100. The multi-orientational connectors and the rods shown in FIGS. 45-47 and FIGS. 48-50 are also physical control elements. These and other physical control elements may be used for directing movement described herein.

Electrical and logic control elements are not shown, but would be known to those skilled in the art. For example, the logic control elements may be implemented as a computer that has associated hardware, software, and/or firmware (a variation, subset, or hybrid of hardware and/or software). For example, the computer may include at least one associated "processing unit" and at least one associated "memory." A processing unit may be a processor (or other known or yet to be discovered processing device) that is capable of implementing steps or actions or directing (directly or indirectly) other components to implement steps or actions. Memory is any computer-readable storage media including non-transitory memory (e.g. RAM memory, flash memory, ROM memory, EPROM memory, EEPROM memory, registers, hard disk, a removable disk, a CD-ROM, a USB drive, or any other form of known or yet to be discovered storage media means). Depending on its purpose, the memory may be transitory and/or non-transitory. Software may be stored (loaded into) in memory. The software may include a program or other form of computer instructions (e.g. computer-readable program code) that may be loaded into memory to produce a machine, such that the instructions that execute on the computer create structures for implementing the steps, actions, or functions described herein.

Miscellaneous

In addition to the features discussed above, the system may include features including, but not limited to, charging capability and/or networking capability (including Internet). Charging may be accomplished through the interconnection rod(s) or other interconnectors (shown or not shown) or using connectionless charging technology known or yet to be discovered. Networking may be accomplished through the interconnection rod(s) or other interconnectors (shown or not shown) or using connectionless (wireless) networking technology known or yet to be discovered.

Although the systems discussed herein are "complete," it should be noted that applicant believes that various components of the system may be retrofitted to components already owned by a practitioner. For example, a practitioner who owns a dental chair and a plurality of technologies might purchase the remainder of the components to retrofit with his existing components. For example, a retrofitting kit for a system such as the system shown in FIGS. 22-23 could include a container with an interconnection flexible rod positioning subsystem, an attachment mechanism (e.g. a halter) to attach the container to the back of the dental chair, a control subsystem, and necessary wiring and electronics. An installer would physically attach the technology to the interconnection flexible rod positioning subsystem so that the technology can transition between the use position and the storage position within the container. The halter would physically secure the container to the back of the chair. The control system and wires would be attached to the interconnection flexible rod positioning subsystem so that the control system controls the technology's transition between the use position and the storage position. The control system could also be in communication with the dental chair so that it could coordinate the position of the chair.

It is to be understood that the inventions, examples, and embodiments described herein are not limited to particularly exemplified materials, methods, and/or structures. It is to be understood that the inventions, examples, and embodiments described herein are to be considered preferred inventions, examples, and embodiments whether specifically identified as such or not. The shown inventions, examples, and embodiments are preferred, but are not meant to be limiting unless specifically claimed, in which case they may limit the scope of that particular claim.

It is to be understood that for methods or procedures disclosed herein that include one or more steps, actions, and/or functions for achieving the described actions and results, the methods' steps, actions, and/or functions may be interchanged with one another without departing from the scope of the present invention. In other words, unless a specific order of steps, actions, and/or functions is required for proper or operative operation of the methods or procedures, the order and/or use of specific steps, actions, and/or functions may be modified without departing from the scope of the present invention.

All references (including, but not limited to, foreign and/or domestic publications, patents, and patent applications) cited herein, whether supra or infra, are hereby incorporated by reference in their entirety.

The terms and expressions that have been employed in the foregoing specification are used as terms of description and not of limitation, and are not intended to exclude equivalents of the features shown and described. While the above is a complete description of selected embodiments of the present invention, it is possible to practice the invention using various alternatives, modifications, adaptations, variations, and/or combinations and their equivalents. It will be appreciated by those of ordinary skill in the art that any arrangement that is calculated to achieve the same purpose may be substituted for the specific embodiment shown. It is also to be understood that the following claims are intended to cover all of the generic and specific features of the invention herein described and all statements of the scope of the invention that, as a matter of language, might be said to fall therebetween.

What is claimed is:

1. A technology associated furniture system including associated technology and adjustable furniture, said system comprising:

(a) the technology being a computer screen technology, a keyboard technology, or a combined computer screen and keyboard technology;

(b) the adjustable furniture having an upright position and a recline position, the adjustable furniture having an upper resting surface, a head end at a first end of the upper surface, a foot end at a second end of the upper surface, and two sides that span the distance between the head end and the foot end of the adjustable furniture;

(c) the system having at least two positions including;

(i) at least one use position in which the technology is available for use; and (ii) a storage position in which the technology is not available for use; and (d) the technology being movable between the at least one use position and the storage position;

(e) wherein movement of the technology between the use position and the storage position is coordinated with the transition between the upright position of the adjustable furniture and the recline position of the adjustable furniture, the coordinated movement implemented at least partially automatically.

2. The system of claim 1, wherein the at least one use position is a patient use position in which the technology is available for patient use.

3. The system of claim 1, wherein the at least one use position is a practitioner use position in which the technology is available for practitioner use.

4. The system of claim 1, wherein the at least one use position is a practitioner use position in which the technology is available for practitioner use, the technology being located near the head end of the adjustable furniture when the system is in the practitioner use position.

5. The system of claim 1, wherein in the storage position, the technology is behind, under, or along the side of the adjustable furniture.

6. The system of claim 1, wherein in the storage position, the technology is in a container.

7. The system of claim 1, wherein in the storage position, the technology is in a sterilizing container.

8. The system of claim 1, wherein in the storage position, the technology is in a sterilizing container having at least one associated sprayer for spraying a chemical sterilizing agent and at least one associated wiper, wherein the technology is sterilized using a series of steps including spray, delay, and wipe.

9. The system of claim 1, wherein the at least one use position is a first practitioner use position and a second practitioner use position, in the first practitioner use position the technology is available for a first practitioner to use, in the second practitioner use position the technology is available for a second practitioner to use, in both the first practitioner use position and the second practitioner use position the technology being located near the head end of the adjustable furniture.

10. The system of claim 1, wherein the at least one use position is a practitioner use position and a patient use position, in the practitioner use position the technology is available for a practitioner to use, in the patient use position the technology is available for a patient to use, in the practitioner use position the technology being located near the head end of the adjustable furniture.

11. The system of claim 1, wherein the adjustable furniture is a dental chair.

12. A technology associated furniture system including associated first and second technology and adjustable furniture, said system comprising:

(a) the adjustable furniture having an upright position and a recline position, the adjustable furniture having an upper resting surface, a head end at a first end of the upper surface, a foot end at a second end of the upper surface, and two sides that span the distance between the head end and the foot end of the adjustable furniture;

(b) the first technology being a computer screen technology, a keyboard technology, or a combined computer screen and keyboard technology, the first technology having at least one patient use position and a storage position, in the at least one patient use position the first technology is available for patient use, the first technology being movable between the at least one patient use position and the storage position; and (c) the second technology being a computer screen technology, a keyboard technology, or a combined computer screen and keyboard technology, the second technology having at least one practitioner use position and a storage position, in the at least one practitioner use position the second technology is available for practitioner use, the second technology being movable between the at least one practitioner use position and the storage position;

(d) wherein movement of the second technology between the use position and the storage position is coordinated with the transition between the upright position of the adjustable furniture and the recline position of the adjustable furniture, the coordinated movement implemented at least partially automatically.

13. The system of claim 12, wherein in the at least one practitioner use position, at least one of the technologies is located near the head end of the adjustable furniture.

14. The system of claim 12, wherein the storage position for the first technology is behind, under, or along the side of the adjustable furniture, and wherein the storage position for the second technology is behind, under, or along the side of the adjustable furniture.

15. The system of claim 12, wherein the storage position for the first technology is in a container, and wherein the storage position for the second technology is in a container.

16. The system of claim 12, wherein the storage position for the first technology is in a sterilizing container, and wherein the storage position for the second technology is in a sterilizing container.

17. The system of claim 12, wherein movement of the first technology between the use position and the storage position is coordinated with the transition between the upright position of the adjustable furniture and the recline position of the adjustable furniture.

18. The system of claim 12, wherein the adjustable furniture is a dental chair.

19. A technology associated furniture system including associated first and second technology and adjustable furniture, said system comprising:

(a) the adjustable furniture having an upright position and a recline position, the adjustable furniture having an upper resting surface, a head end at a first end of the upper surface, a foot end at a second end of the upper surface, and two sides that span the distance between the head end and the foot end of the adjustable furniture;

(b) the first technology being a computer screen technology, a keyboard technology, or a combined computer screen and keyboard technology, the first technology having at least one patient use position and a storage position, in the at least one patient use position the first technology is available for patient use, the first technology being movable between the at least one patient use position and the storage position, and the storage position for the first technology being in a container; and (c) the second technology being a computer screen technology, a keyboard technology, or a combined computer screen and keyboard technology, the second technology having at least one practitioner use position and a storage position, in the at least one practitioner use position the second technology is available for practitioner use, the second technology being movable between the at least one practitioner use position and the storage position, wherein the at least one practitioner use position is located near the head end of the adjustable furniture, and the storage position for the second technology being in a container;

(d) wherein movement of the first and second technologies between the use positions and the storage positions is coordinated with the transition between the upright position of the adjustable furniture and the recline position of the adjustable furniture, the coordinated movement implemented at least partially automatically.

20. The system of claim 19, wherein the storage position for the first technology is behind, under, or along the side of the adjustable furniture, and wherein the storage position for the second technology is behind, under, or along the side of the adjustable furniture.

21. The system of claim 19, wherein the storage position for the first technology is in a sterilizing container, and wherein the storage position for the second technology is in a sterilizing container.

22. The system of claim 19, wherein the adjustable furniture is a dental chair.

* * * * *